US007918120B2

(12) United States Patent
Suzuki

(10) Patent No.: US 7,918,120 B2
(45) Date of Patent: Apr. 5, 2011

(54) DIE CUSHION CONTROL DEVICE

(75) Inventor: Yuichi Suzuki, Komatsu (JP)

(73) Assignees: Komatsu Ltd., Tokyo (JP); Komatsu Industries Corp., Ishikawa (JP)

( * ) Notice: Subject to any disclaimer, the term of this patent is extended or adjusted under 35 U.S.C. 154(b) by 809 days.

(21) Appl. No.: 11/908,485

(22) PCT Filed: Mar. 13, 2006

(86) PCT No.: PCT/JP2006/304858

§ 371 (c)(1),
(2), (4) Date: Sep. 12, 2007

(87) PCT Pub. No.: WO2006/098256

PCT Pub. Date: Sep. 21, 2006

(65) Prior Publication Data

US 2009/0025444 A1 Jan. 29, 2009

(30) Foreign Application Priority Data

Mar. 16, 2005 (JP) ..... 2005-075336

(51) Int. Cl.
*B21J 9/18* (2006.01)
*B21D 22/00* (2006.01)
*B21C 51/00* (2006.01)

(52) U.S. Cl. ..... 72/453.13; 72/350; 72/16.1

(58) Field of Classification Search ..... 72/16.1, 72/16.2, 20.1, 21.5, 350, 351, 453.13
See application file for complete search history.

(56) References Cited

U.S. PATENT DOCUMENTS

| | | | |
|---|---|---|---|
| 2005/0274243 | A1 | 12/2005 | Shiroza et al. |
| 2006/0012326 | A1 | 1/2006 | Iwashita et al. |
| 2007/0006632 | A1 | 1/2007 | Iwashita et al. |
| 2009/0126453 | A1 | 5/2009 | Suzuki |

FOREIGN PATENT DOCUMENTS

| | | | |
|---|---|---|---|
| EP | 1 741 500 | A1 | 1/2007 |
| JP | 10-192997 | A | 7/1998 |
| JP | 10-202327 | A | 8/1998 |
| JP | 2002-007296 | A | 1/2006 |
| JP | 2006-026738 | A | 2/2006 |

OTHER PUBLICATIONS

German Office Action dated Jul. 18, 2008 and English translation thereof issued in counterpart German Appln. No. 112006000608.8.
Notification Concerning Transmittal of International Preliminary Report on Patentability, Chapter I of the Patent Cooperation Treaty, and Written Opinion of the International Searching Authority, dated Sep. 18, 2007 for PCT/JP2008/304858, 4 sheets.

*Primary Examiner* — Dana Ross
*Assistant Examiner* — Teresa M Ekiert
(74) *Attorney, Agent, or Firm* — Holtz, Holtz, Goodman & Chick, PC

(57) ABSTRACT

A die cushion controller controls an ascending/descending speed of a die cushion pad based on a preset pressure pattern and positional pattern. A position/pressure control switching unit constantly monitors and compares a first speed command signal υpc corresponding to a pressure deviation signal ep and a second speed command signal υhc corresponding to a position deviation signal eh, and selects a smaller one of the speed command signals to be sent to a speed control unit.

1 Claim, 29 Drawing Sheets

DIE CUSHION CONTROL DEVICE

This application is a U.S. National Phase Application under 35 USC 371 of International Application PCT/JP2006/304858 filed Mar. 13, 2006.

TECHNICAL FIELD

The present invention relates to a die cushion controller of a press machine used for drawing or the like, in particular, a die cushion controller that controls the operation of a die cushion pad in synchronism with the movement of a slide.

BACKGROUND ART

There is conventionally known a die cushion controller that controls the ascent/descent movement of a die cushion pad driven by a servomotor, which, for example, is proposed in Patent Document 1. In the die cushion controller according to Patent Document 1, until the upper die of the slide comes into contact with the die cushion pad with a workpiece sandwiched therebetween, the control of the cushion stroke of the die cushion is effected through position control. Upon detecting a change in the electric current of the servomotor when a load starts to be applied to the die cushion pad, a current change detection signal is issued, and switching is thereby effected from the position control to pressure control to impart a preset cushion pressure to the die cushion pad. In this die cushion controller, switching from position control to pressure control is possible, so that drawing can be performed in a satisfactory manner.

DISCLOSURE OF THE INVENTION

Problems to be Solved by the Invention

However, in the above-mentioned die cushion controller, the switching between position control and pressure control is effected through detection of a predetermined change in the electric current of the servomotor and output of a detection signal, which means the electric current is not constantly monitored for any change. Thus, a change in the electric current of the servomotor cannot be correctly detected in some cases due to impact, vibration or the like generated when the upper die comes into contact with the die cushion pad, making the operation of switching from position control to pressure control unstable. In such cases, switching to pressure control cannot be effected with an appropriate timing, and the control of the operation of the die cushion pad becomes unstable, making it impossible to perform drawing in a satisfactory manner. In particular, since the control of the die cushion performed when the upper die comes into contact with the workpiece (die cushion pad) plays vital role in obtaining a satisfactory product, high precision control is required.

It is an object of the present invention to provide a die cushion controller capable of switching between position control and pressure control in a stable manner and of controlling the operation of the die cushion with high accuracy to allow molding in a satisfactory manner.

Means for Solving the Problems

A die cushion controller according to the present invention is characterized by including: a pressure command signal output unit that outputs a pressure command signal corresponding to a pressure target value based on a predetermined pressure pattern; a pressure detecting means that detects a pressure applied to a die cushion pad; a pressure comparing unit that outputs a pressure deviation signal corresponding to a deviation between the pressure target value based on the pressure pattern and a pressure detection value based on a pressure detection signal from the pressure detecting means; a pressure control unit that outputs a first speed command signal based on the pressure deviation signal; a position command signal output unit that outputs a position command signal corresponding to a position target value based on a predetermined positional pattern; a position detecting means that detects a position of the die cushion pad; a position comparing unit that outputs a position deviation signal corresponding to a deviation between the position target value based on the positional pattern and a position detection value based on a position detection signal from the position detecting means; a position control unit that outputs a second speed command signal based on the position deviation signal; a position/pressure control switching unit that selects the first speed command signal or the second speed command signal; a speed control unit that outputs a motor current command signal based on the first speed command signal or the second speed command signal from the position/pressure control switching unit; and a servo amplifier that supplies an electric servomotor which drives a die cushion with an electric current corresponding to the motor current command signal, in which the position/pressure control switching unit selects smaller one of the first speed command signal and the second speed command signal.

According to the present invention, the pressure comparing unit outputs the pressure deviation signal corresponding to the deviation between the pressure target value and the pressure detection value, and, based on this pressure deviation signal, the pressure control unit outputs the first speed command signal. On the other hand, the position comparing unit outputs the position deviation signal corresponding to the deviation between the position target value and the position detection value, and, based on this position deviation signal, the position control unit outputs the second speed command signal. The position/pressure control switching unit constantly monitors and compares the first speed command signal and the second speed command signal, selecting the smaller one of the two. Thus, as compared with the conventional technique in which switching is effected solely through the output of a detection signal indicating a change in the electric current of the servomotor, the change in pressure and the change in position can be more accurately recognized, so that the switching can be effected in a stable manner. Thus, the operation of the die cushion is stabilized.

Further, since the switching is effected by monitoring both the second speed command signal and the first speed command signal, it is possible to effect the switching more quickly and reliably as compared with the conventional technique in which solely the change in the electric current of the servomotor is monitored.

EXPLANATION OF CODES

9 . . . workpiece, 13, 13A, 13B . . . die cushion, 15 . . . die cushion pad, 21 . . . electric servomotor, 32 . . . strain gauge (pressure detecting means), 33 . . . linear scale (position detecting means), 36 . . . encoder (position detecting means), 40 . . . die cushion controller, 42 . . . servo amplifier, 45 . . . position command signal output unit, 46 . . . position comparing unit, 47 . . . position control unit, 48 . . . pressure command signal output unit, 49 . . . pressure comparing unit, 50 . . . pressure control unit, 51 . . . position/pressure control switching unit, 53 . . . speed control unit, 54 . . . positional pattern, 56 . . . pressure pattern, 75 . . . linear servomotor (electric servomotor), 93 . . . pressure gauge (pressure detecting means), Pc . . . pressure command signal, ep . . . pressure deviation signal, υpc . . . first speed command signal, ic . . . motor current command signal, i . . . motor current (electric current), hc . . . position command signal, eh . . . position deviation signal, υhc . . . second speed command signal

BEST MODE FOR CARRYING OUT THE INVENTION

Next, specific embodiments of the die cushion controller of the present invention will be described with reference to the drawings.

First Embodiment

Figure 1:
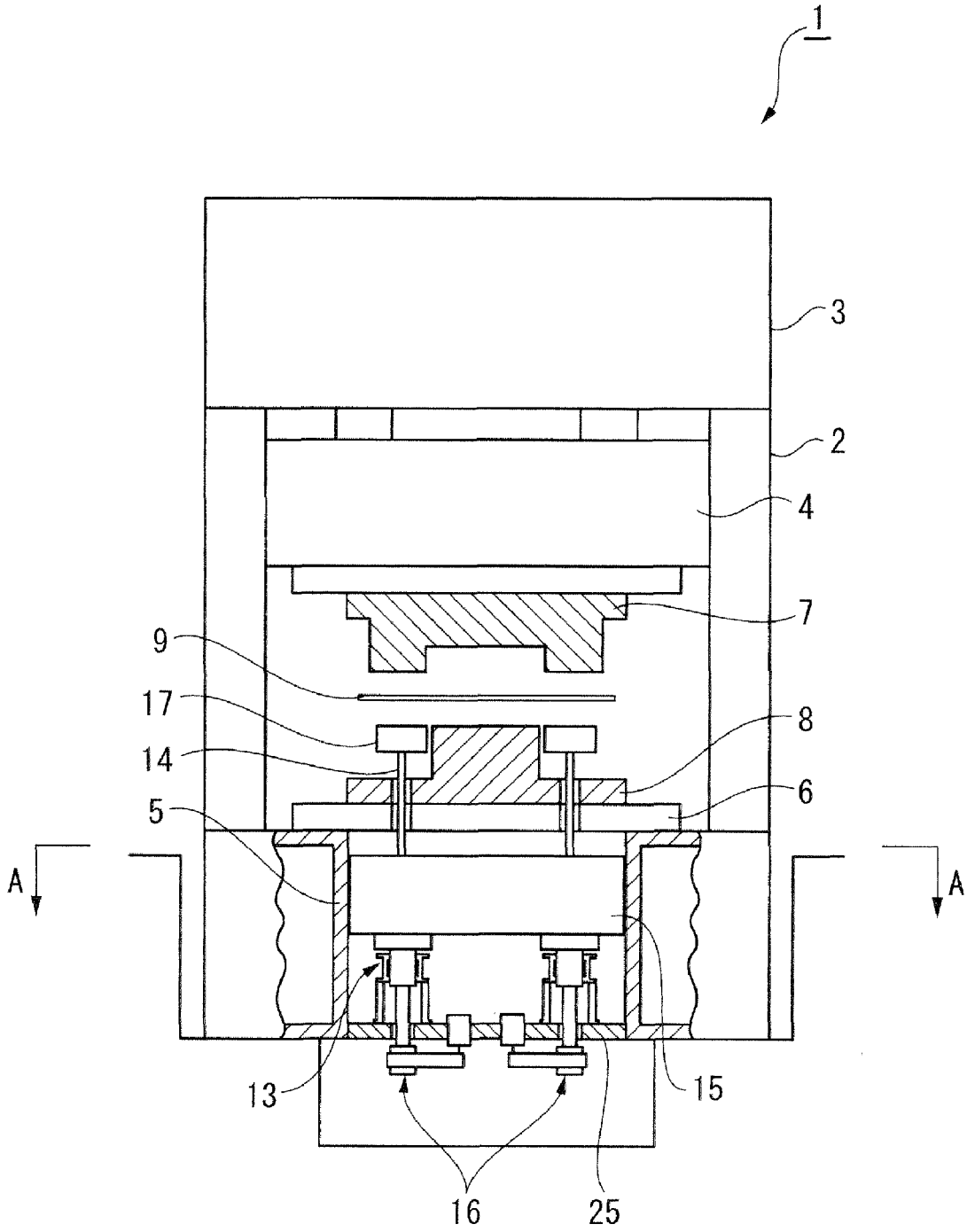
FIG. 1 A schematic structural view of a press machine according to a first embodiment of the present invention.
Figure 2:
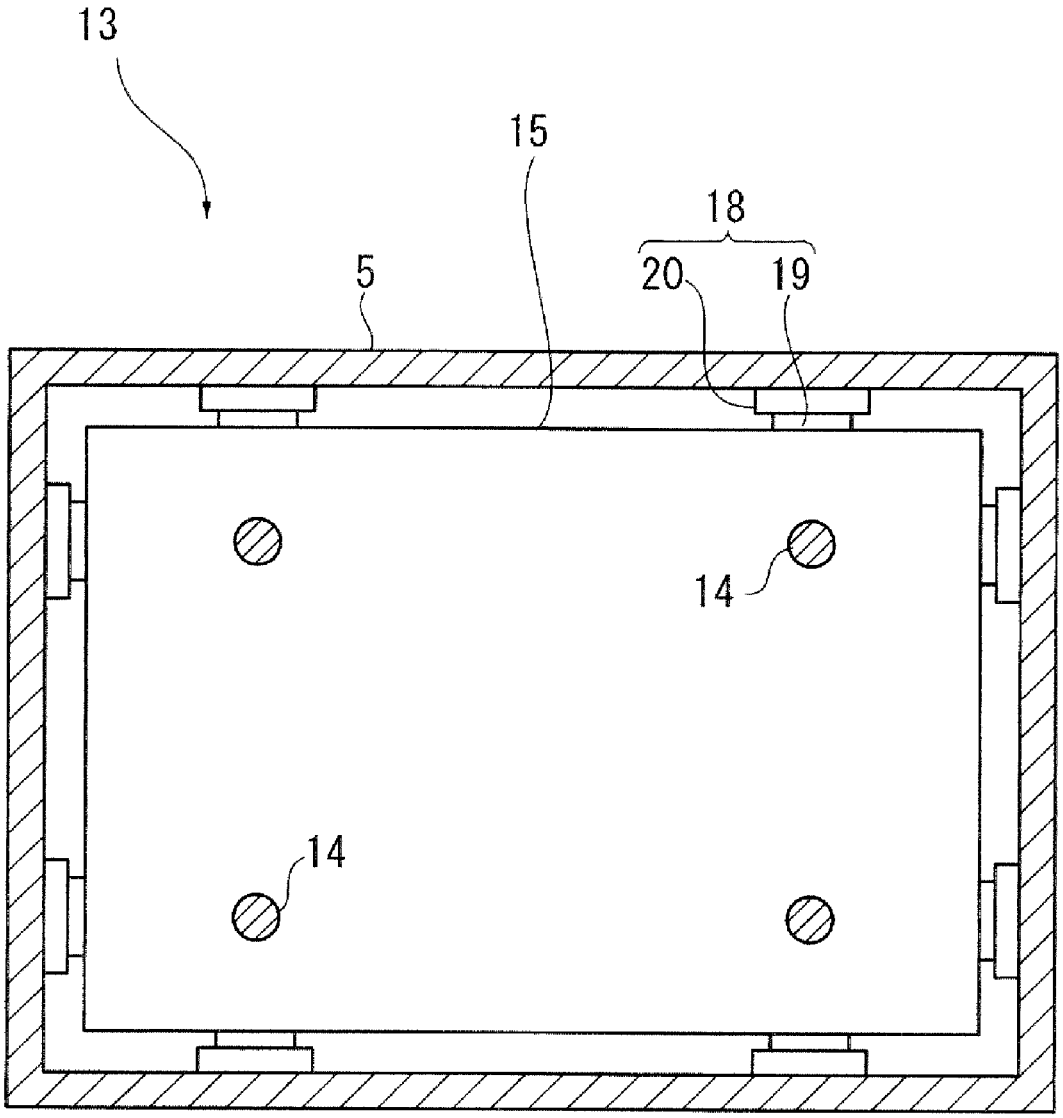
FIG. 2 A sectional view of a primary portion taken along the arrow line A-A of FIG. 1.
Figure 3:
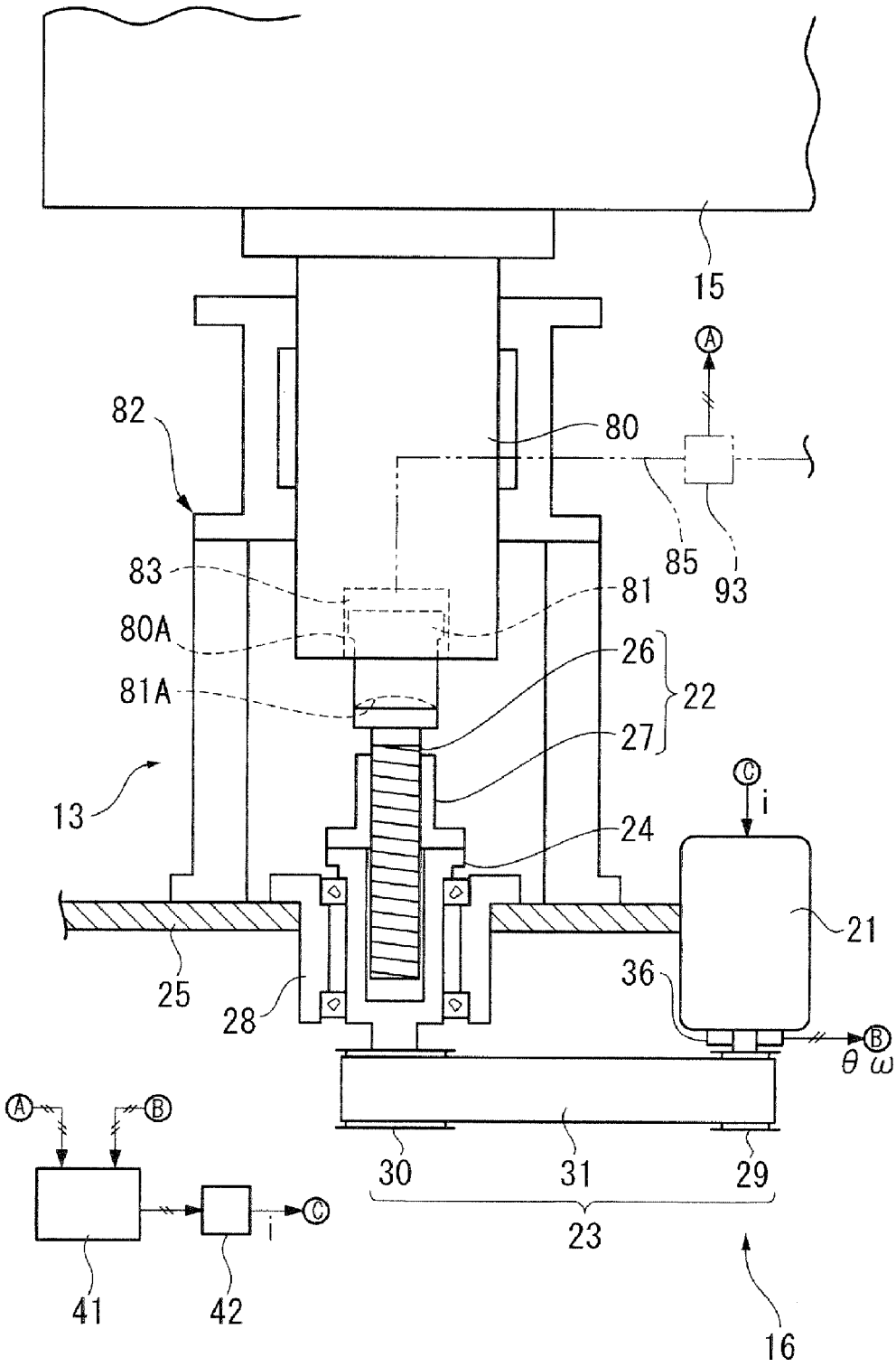
FIG. 3 A schematic structural view of a die cushion according to the first embodiment.

FIG. 1 is a schematic structural view of a press machine according to a first embodiment of the present invention. FIG. 2 is a main portion sectional view taken along the arrow line A-A of FIG. 1. FIG. 3 is a schematic structural view of a die cushion according to the first embodiment.

FIG. 1 shows a press machine 1 which is equipped with a slide 4 driven to ascend and descend by a slide drive mechanism 3 supported by a main body frame 2 so as to be capable of ascending and descending, and a bolster 6 opposed to the slide 4 and mounted to a bed 5. An upper die 7 is mounted to the lower side of the slide 4, and a lower die 8 is mounted to the upper side of the bolster 6. Thus, press working (drawing) is performed on a workpiece 9 arranged between the upper die 7 and the lower die 8 by ascent/descent movement of the slide 4.

In this structure, a die cushion 13 is built in the bed 5. The die cushion 13 is equipped with a requisite number of die cushion pins 14, a die cushion pad 15 supported within and by the bed 5 so as to be capable of ascending and descending, and die cushion pad drive mechanisms 16 for raising and lowering the die cushion pad 15.

The die cushion pins 14 are passed through holes formed in the bolster 6 and the lower die 8 so as to vertically extend therethrough. The upper end of each die cushion pin 14 abuts to a blank holder 17 arranged in a recess of the lower die 8, and the lower end thereof abuts to the die cushion pad 15.

As shown in FIG. 2, between each lateral side of the die cushion pad 15 and the inner wall surface of the bed 5 opposed thereto, there are provided one or more (two in this embodiment) guide members 18 vertically guiding the die cushion pad 15. Each guide member 18 is constructed of a pair of inner guide 19 and outer guide 20 engaged with each other; the inner guide 19 is attached to each lateral side of the die cushion pad 15, and the outer guide 20 is attached to the inner wall surface of the bed 5. In this way, the die cushion pad 15 is supported within and by the bed 5 so as to be capable of ascending and descending.

As shown in FIG. 3, the die cushion pad drive mechanism 16 is equipped with an electric servomotor 21 as the drive source, a ball screw mechanism 22 as a means for raising and lowering the die cushion pad 15, and a belt transmission mechanism 23 and a connecting member 24 that are arranged in a power transmission route between the electric servomotor 21 and the ball screw mechanism 22 to allow power transmission between the die cushion pad 15 and the electric servomotor 21.

The electric servomotor 21 is a rotary AC servomotor with a rotation shaft. The rotating speed and the torque of the rotation shaft are controlled through control of a motor current (electric current) i supplied to the electric servomotor 21. The main body portion of the electric servomotor 21 is fixed to a beam 25 extended between the inner wall surfaces of the bed 5. Further, an encoder (position detecting means) 36 is annexed to the electric servomotor 21. The encoder 36 detects the angle and the angular velocity of the rotation shaft of the electric servomotor 21, and outputs the detection values as a motor rotation angle detection signal θ and a motor rotation angular velocity detection signal to, respectively. The motor rotation angle detection signal θ and the motor rotation angular velocity detection signal ω output from the encoder 36 are input to a controller 41 described below.

The ball screw mechanism 22 includes a screw portion 26 and a nut portion 27 threaded therewith, and has a function to convert by the screw portion 26 rotational power input from the nut portion 27 to linear power and to output the same. The lower end portion of the screw portion 26 is arranged so as to be capable of advancing and retreating within a space formed in the central portion of the connecting member 24, and the lower end portion of the nut portion 27 is connected to the upper end portion of the connecting member 24. The connecting member 24 is supported by the beam 25 through the intermediation of a bearing device 28 constructed of bearings and a bearing housing accommodating the bearings.

The belt transmission mechanism 23 is formed by a small pulley 29 fixed to the rotation shaft of the electric servomotor 21, a large pulley 30 fixed to the lower end portion of the connecting member 24, and a timing belt 31 stretched between the pulleys.

In the above-mentioned construction, the rotational power of the electric servomotor 21 is transmitted to the nut portion 27 of the ball screw mechanism 22 through the small pulley 29, the timing belt 31, the large pulley 30 and the connecting member 24, and the screw portion 26 of the ball screw mechanism 22 is moved in the vertical direction by the rotational power transmitted to the nut portion 27, whereby the die cushion pad 15 is caused to ascend and descend. By controlling the motor current i supplied to the electric servomotor 21, an urging force applied to the die cushion pad 15 is controlled.

In the die cushion 13, a plunger rod 80 is connected to the lower end portion of the die cushion pad 15. The side surface of the plunger rod 80 is slidably supported by a cylindrical plunger guide 82. The plunger guide 82 has a function to guide the plunger rod 80 and the die cushion pad 15 connected to the plunger rod 80 in the ascending/descending direction. In the lower portion of the plunger rod 80, there is provided a cylinder 80A having a downwardly directed opening, within which a piston 81 is slidably accommodated.

A hydraulic chamber 83 is formed by the inner wall surface of the cylinder 80A and the upper surface of the piston 81, and the hydraulic chamber 83 is filled with pressure oil. The axis of the hydraulic chamber 83 coincides with the axes of the plunger rod 80 and the ball screw mechanism 22. The pressure oil port of the hydraulic chamber 83 is connected to the hydraulic circuit shown in FIG. 4, and pressure oil is exchanged between the hydraulic chamber 83 and the hydraulic circuit. The pressure oil of the hydraulic chamber 83 mitigates the impact generated when the upper die 7 comes into contact with the workpiece 9. Further when the oil pressure exceeds a predetermined value, the pressure oil is discharged into a tank 91 (see FIG. 4). Thus, the pressure oil of the hydraulic chamber 83 has an overload protection function.

The lower end of the piston 81 abuts to the upper end of the screw portion 26 of the ball screw mechanism 22. A spherical concave surface 81A is formed at the lower end of the piston 81, and a spherical convex surface is formed at the upper end of the screw portion 26 opposed to the concave surface 81A. Conversely, it is also possible to form a convex surface at the lower end of the piston 81, forming a concave surface at the upper end of the screw portion 26C. While a bar-like member like the screw portion 26 is resistant to an axial force applied to an end portion thereof, it is vulnerable to bending moment. When the upper end of the screw portion 26 has a spherical configuration, even if the die cushion pad 15 is inclined to generate bending moment at the upper end of the screw portion 26, only an axial force is applied to the screw portion 26 as a whole. With this structure, it is possible to prevent damage of the screw portion 26C attributable to an eccentric load.

In the die cushion 13, the pressure of the hydraulic chamber 83 is detected in the above-mentioned hydraulic circuit. In the hydraulic circuit diagram of FIG. 4, the port of the hydraulic chamber 83 is connected to one port of a supply side control valve 86 and one port of a discharge side control valve 87 through a duct 85. The other port of the supply side control valve 86 is connected to a discharge port of a hydraulic pump 89 through a duct 88. An inlet port of the hydraulic pump 89 is connected to the tank 91 through a duct 90. The other port of the discharge side control valve 87 is connected to the tank 91 through a duct 92. The supply side control valve 86 is opened only when working fluid of the tank 91 is to be supplied to the hydraulic chamber 83, and the discharge side control valve 87 is opened only when the pressure oil of the hydraulic chamber 83 is to be discharged into the tank 91.

A pressure gauge (pressure detecting means) 93 is provided in the duct 85. The pressure gauge 93 detects the pressure of the hydraulic chamber 83, that is, the load generated in the die cushion pad 15. A pressure detection signal Pr is output from the pressure gauge 93 to a pressure comparing unit 49 of a controller 41 and to a pressure shaft control unit 94. The pressure comparing unit 49 will be described below. The pressure shaft control unit 94 inputs the pressure detection signal Pr from the pressure gauge 93, and outputs a control signal to the supply side control valve 86 and the discharge side control valve 87 to control the opening/closing operation of the control valves 86, 87.

Figure 4:
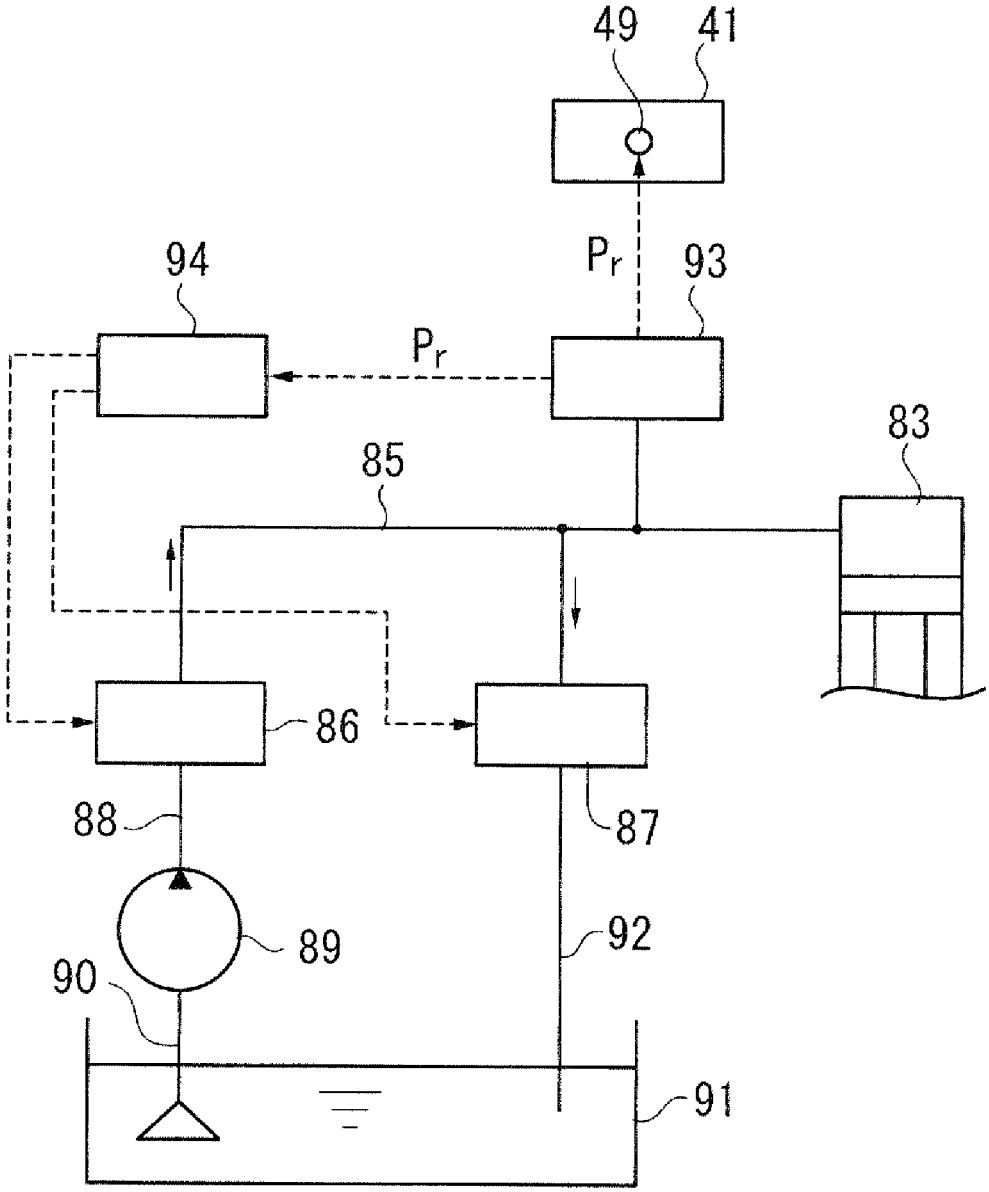
FIG. 4 A hydraulic circuit diagram of the die cushion.

The hydraulic circuit shown in FIG. 4 has an overload preventing function. That is, when the upper die 7 and the workpiece 9 come into contact with each other to generate a load in the die cushion pad 15, the pressure of the hydraulic chamber 83 increases. When the detection value of the pressure gauge 93 exceeds a predetermined value, there is a fear of an overload being generated. In such cases, an opening signal is output from the pressure shaft control unit 94 to the discharge side control valve 87, and the discharge side control valve 87 is opened. Then, the pressure oil of the hydraulic chamber 83 is discharged into the tank 91. Then, a system (not shown) operates to effect emergency stop of the operation of the press machine 1. In this way, the press machine 1 stops upon discharge of the pressure oil from the hydraulic chamber 83, so that generation of an overload is prevented.

Further, it is also possible to provide a relief valve instead of the discharge side control valve 87; when the pressure of the hydraulic chamber 83 exceeds a predetermined pressure, the relief valve operates to discharge pressure oil.

Next, the construction of a die cushion controller 40 that controls the die cushion 13 will be described with reference to the functional block diagram of FIG. 5 and the control block diagram of FIG. 6.

Figure 5:
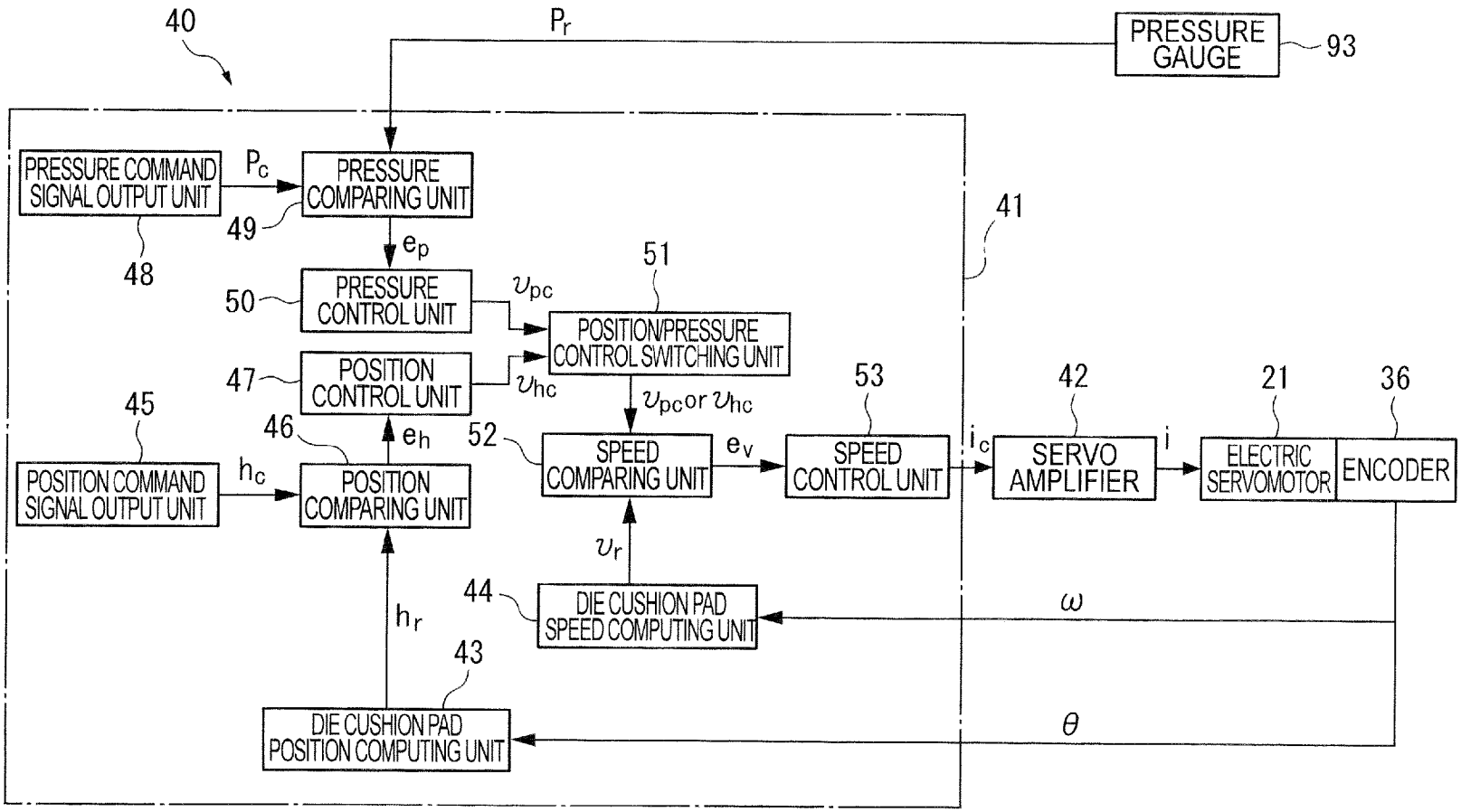
FIG. 5 A functional block diagram showing a die cushion controller.
Figure 6:
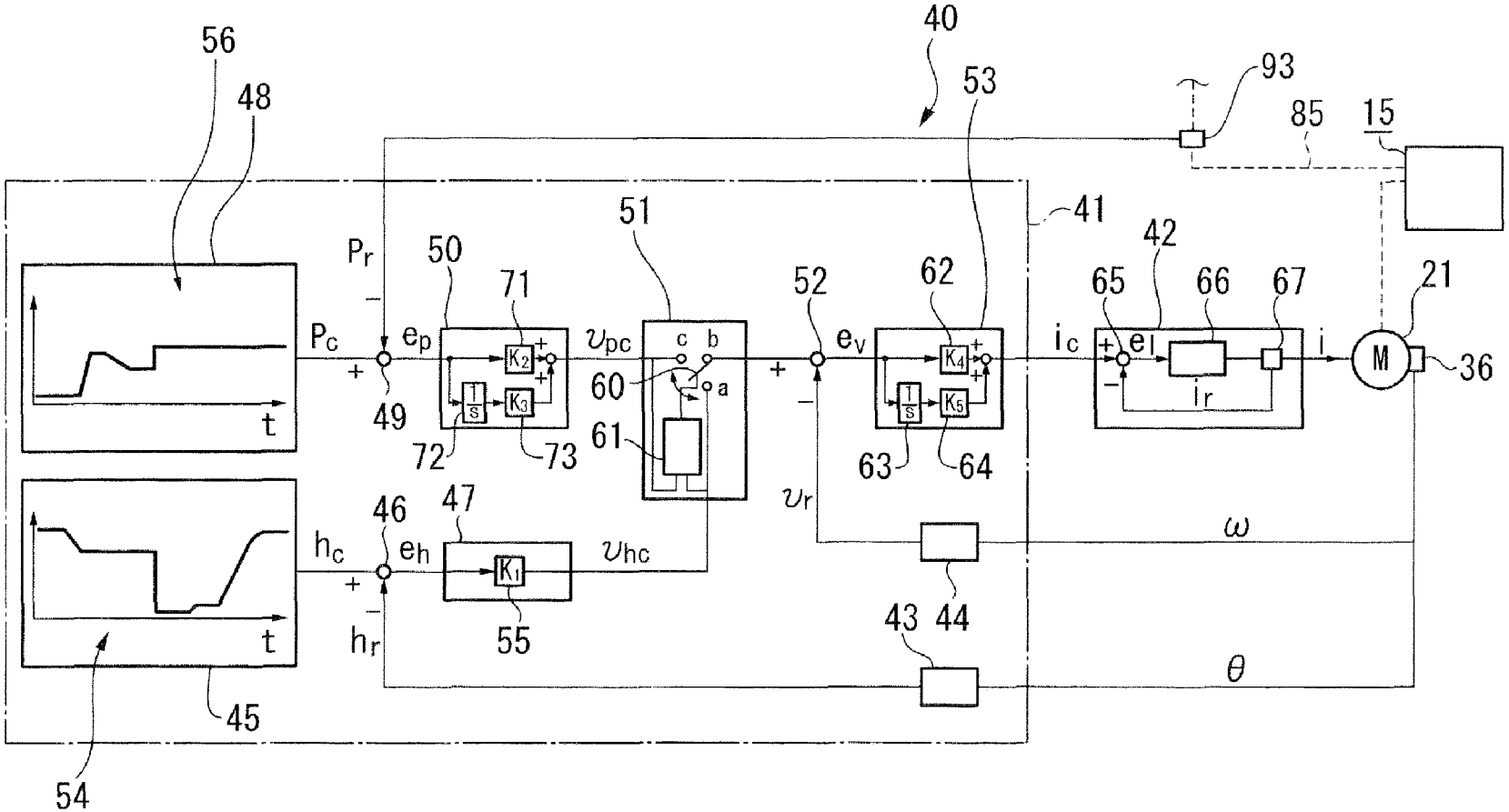
FIG. 6 A control block diagram showing the die cushion controller.

The die cushion controller 40 shown in FIGS. 5 and 6 is equipped with the controller 41, and a servo amplifier 42 that supplies the electric servomotor 21 with an electric current i corresponding to a motor current command signal is output from the controller 41.

Although not described in detail with reference to a drawing, the controller 41 is equipped with an input interface that transforms/shapes various input signals, a computer apparatus mainly constructed of a microcomputer, a high speed value computing processor, etc. and adapted to execute arithmetical/logical operation on input data according to predetermined procedures, and an output interface that outputs the operation result after converting into a control signal. Formed in the controller 41 are various functional units such as a die cushion pad position computing unit 43, a die cushion pad speed computing unit 44, a position command signal output unit 45, a position comparing unit 46, a position control unit 47, a pressure command signal output unit 48, a pressure comparing unit 49, a pressure control unit 50, a position/pressure control switching unit 51, a speed comparing unit 52, and a speed control unit 53.

The die cushion pad position computing unit 43 has a function to input a motor rotation angle detection signal θ from the encoder 36 provided on the electric servomotor 21, to obtain the position of the die cushion pad 15 in a predetermined relationship with the motor rotation angle based on this input signal, and to output the result as a die cushion pad position detection signal (position detection signal) hr.

The die cushion pad speed computing unit 44 has a function to input a motor rotation angular velocity detection signal ω from the encoder 36, to obtain the speed (ascending/descending speed) of the die cushion pad 15 in a predetermined relationship with the motor rotating speed based on this input signal, and to output the result as a die cushion pad speed detection signal υr.

The position command signal output unit 45 has a function to obtain a position target value for the die cushion pad 15 by referring to a preset positional pattern 54, and to generate/output a positional command signal hc based on the obtained position target value. Here, the positional pattern 54 indicates a desired correlation between time and the die cushion pad position.

The position comparing unit 46 has a function to compare the position command signal hc from the position command signal output unit 45 with the die cushion pad position detection signal hr from the die cushion pad position computing unit 43, and to output a position deviation signal eh.

The position control unit 47 is equipped with a coefficient multiplier 55 inputting the position deviation signal eh from the position comparing unit 46 and multiplying the input signal by a predetermined position gain K1 before outputting the same, and has a function to generate/output a second speed command signal υhc of a magnitude corresponding to the position deviation signal eh.

The pressure command signal output unit 48 has a function to obtain a pressure (cushion pressure) target value generated at the die cushion pad 15 with reference to a preset pressure pattern 56, and to generate/output a pressure command signal Pc based on the obtained pressure target value. Here, the pressure pattern 56 indicates a desired correlation between time and the pressure generated in the die cushion pad 15.

The pressure comparing unit 49 has a function to compare the pressure command signal Pc from the pressure command signal output unit 48 with the pressure detection signal Pr from the pressure gauge 93 to output a pressure deviation signal ep.

The pressure control unit 50 is equipped with a coefficient multiplier 71 inputting the pressure deviation signal ep from the pressure comparing unit 49 and multiplying the input signal by a predetermined proportional gain K2 to output the same, an integrator 72 inputting the pressure deviation signal ep from the pressure comparing unit 49 and integrating the input signal to output the same (the symbol s in the block diagram indicates a Laplace operator), and a coefficient multiplier 73 inputting the output signal from the integrator 72 and multiplying the input signal by a predetermined integral gain K3 to output the same. The pressure control unit 50 adds the output signal from the coefficient multiplier 73 to the output signal from the coefficient multiplier 71, and to generate/output a first speed command signal υpc.

In the pressure control unit 50, there is conducted a proportional+integral action (PI action) in which a proportional action (P action) and an integral action (I action) are combined with each other, whereby there is output from the pressure control unit 50 a first speed command signal υpc which is of a magnitude corresponding to the pressure deviation signal ep and whose magnitude increases as long as the pressure deviation signal ep exists, with the detected pressure being quickly and correctly matched with the target pressure.

The position/pressure control switching unit 51 is adapted to effect switching between position control for controlling the position of the die cushion pad 15 and pressure control for controlling the pressure generated in the die cushion pad 15, and is equipped with a switch 60 that effects switching between an a-contact and a c-contact using a b-contact as the reference, and a position/pressure comparing unit 61 for effecting selection of the switching operation of the switch 60.

When the b-contact and the a-contact are connected with each other by the switch 60 (hereinafter, this connecting operation will be referred to as "b-a contact connecting operation"), the second speed command signal υhc from the position control unit 47 is supplied to the speed comparing unit 52. When the b-contact and the c-contact are connected with each other by the switch 60 (hereinafter, this connecting operation will be referred to as "b-c contact connecting operation"), the first speed command signal υpc from the pressure control unit 50 is supplied to the speed comparing unit 52.

The position/pressure comparing unit 61 is set such that it compares the first speed command signal υpc from the pressure control unit 50 with the second speed command signal υhc from the position control unit 47 and selects the smaller one of the two.

Figure 7:
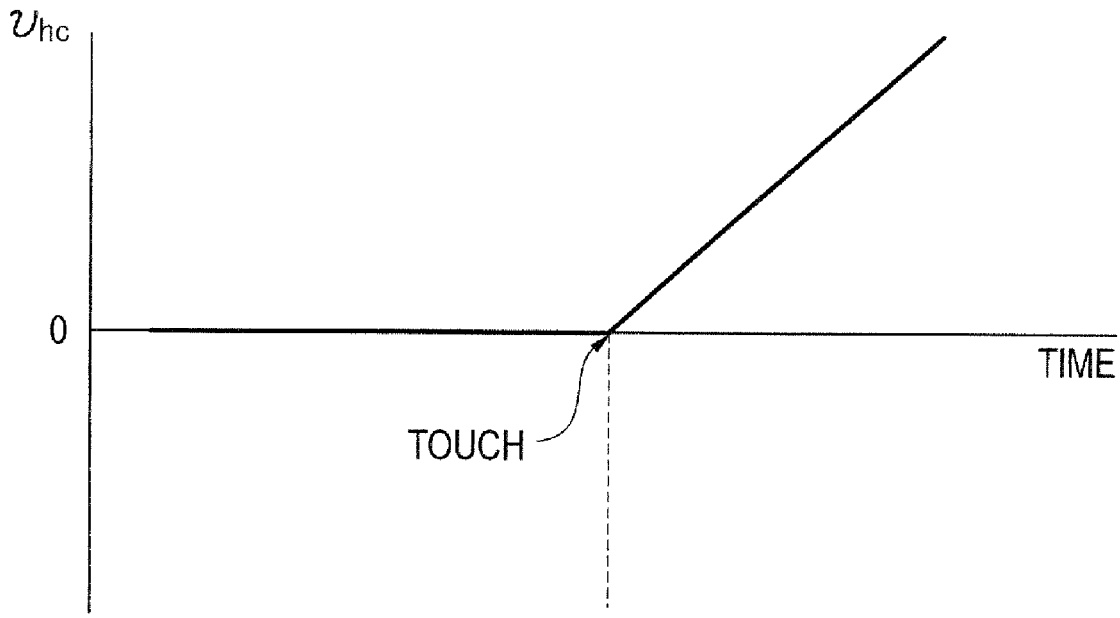
FIG. 7 A diagram showing the relationship between time and a second speed command signal.

Here, the switching logic of the position/pressure comparing unit 61 will be described with reference to FIGS. 7 through 9. FIG. 7 shows the second speed command signal υhc. In FIG. 7, when the positional pattern (position target value) of the die cushion pad 15 is constantly set to 0 (standby position), the position of the die cushion pad 15 coincides with the standby position before the upper die 7 comes into contact with the workpiece 9, so that the position deviation signal eh is 0, and the second speed command signal υhc is 0. When, thereafter, the upper die 7 reaches the position (touch position) where it is in contact with the workpiece 9, the die cushion pad 15 starts to be lowered as the upper die 7 descends, so that the position deviation signal eh gradually increases, in accordance with which the second speed command signal υhc also increases.

Figure 8:
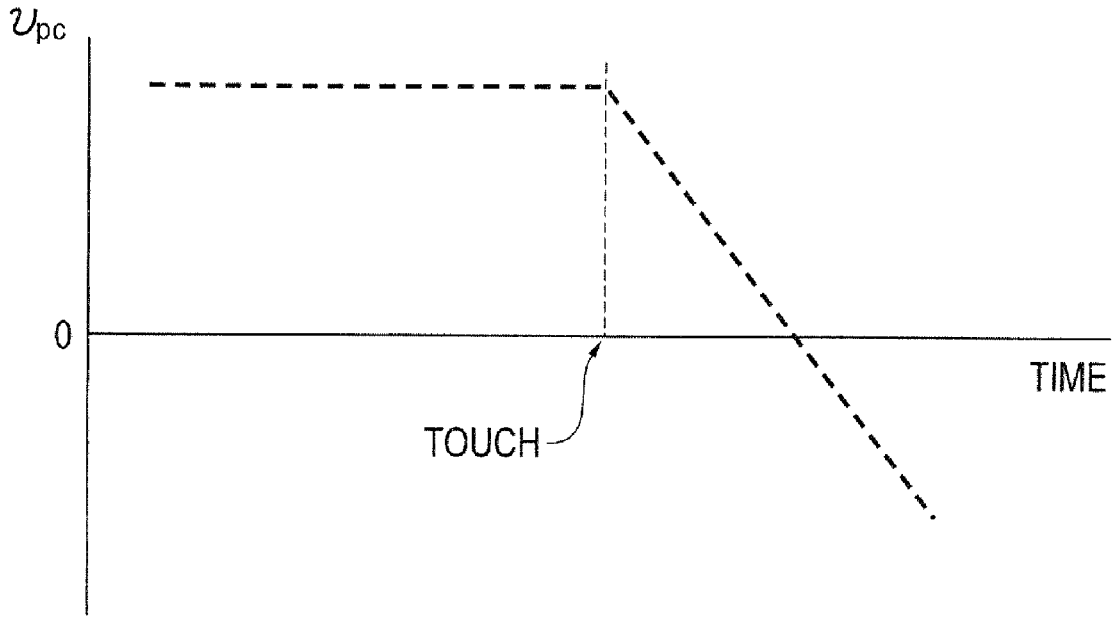
FIG. 8 A diagram showing the relationship between time and a first speed command signal.

FIG. 8 shows the first speed command signal υpc. In FIG. 8, when the pressure pattern of the die cushion pad 15 is constantly set to a fixed value, no pressure is generated in the die cushion pad 15 before the upper die 7 comes into contact with the workpiece 9, so that the pressure deviation signal ep coincides with the fixed value of the pressure pattern, and the first speed command signal υpc attains a value corresponding to the fixed value of the pressure pattern. When, thereafter, the upper die 7 reaches the position where it is in contact with the workpiece 9 (touch position), the die cushion pad 15 is pressed by the upper die 7 to generate pressure. This pressure increases as the die cushion pad 15 descends, so that the pressure deviation signal ep gradually decreases, and, in accordance therewith, the first speed command signal υpc also decreases.

Figure 9:
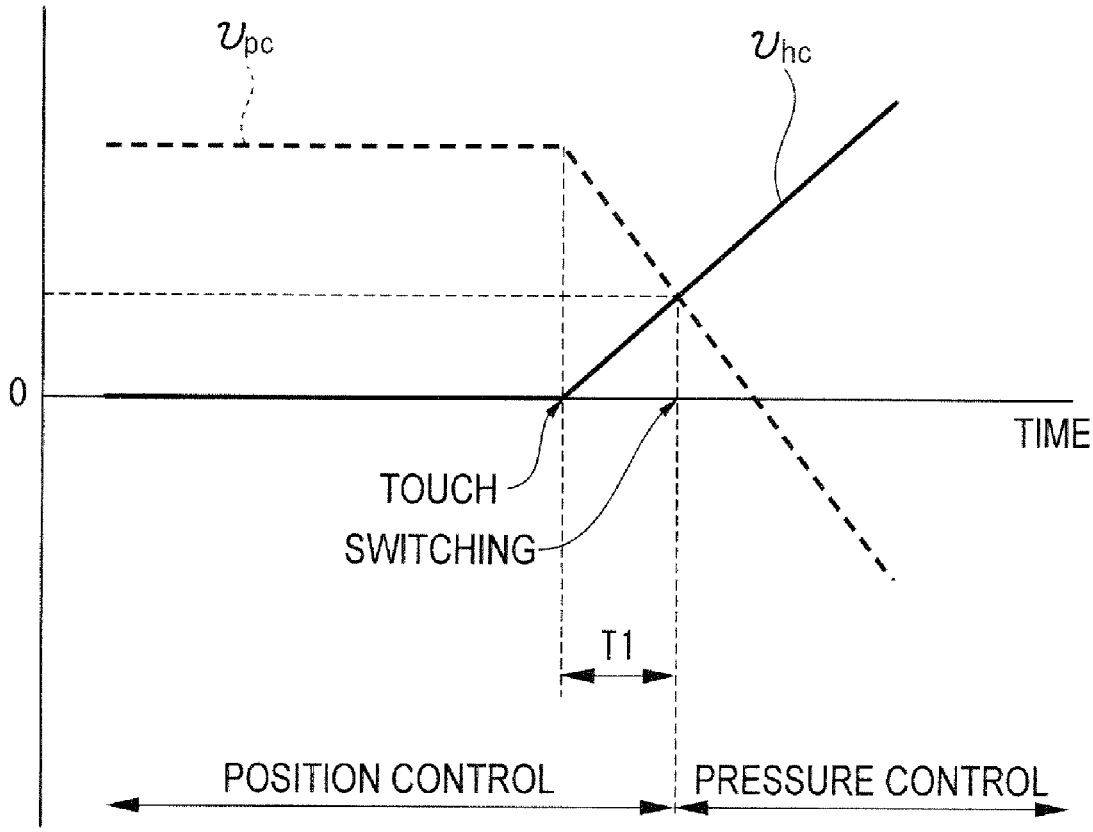
FIG. 9 An explanatory view for illustrating the operation of switching between position control and pressure control.

As shown in FIG. 9, the position/pressure comparing unit 61 is set so as to compare the second speed command signal υhc and the first speed command signal υpc, selecting the smaller one of the two. Thus, during descent of the upper die 7 before it comes into contact with the workpiece 9, since the second speed command signal υhc is smaller than the first speed command signal υpc, the second speed command signal υhc is selected. As a result of this selection, the b-contact and the a-contact are connected by the switch 60, and the second speed command signal υhc is supplied to the speed comparing unit 52, whereby position control is effected.

Next, when the upper die 7 reaches the touch position where it is in contact with the workpiece, the second speed command signal υhc increases and the first speed command signal υpc decreases. When, after the elapse of time T1, the magnitude relationship between the speed command signals υhc and υpc is reversed, the position/pressure comparing unit 61 selects the first speed command signal υpc, which is smaller than the second speed command signal υhc, and the b-contact and the c-contact of the switch 60 are connected. Through this connection switching operation, the first speed command signal υpc is supplied to the speed comparing unit 52, and pressure control is effected.

Since the position/pressure comparing unit 61 is set so as to constantly compare the second speed command signal υhc and the first speed command signal υpc and to select smaller of the two, it is possible to effect the switching between position control and pressure control automatically with an appropriate timing. Thus, it is possible to minimize the influence of the impact, vibration or the like when the upper die 7 comes into contact with the die cushion pad 15 through the intermediation of the workpiece 9, making it possible to effect switching between position control and pressure control reliably with an appropriate timing and in a stable manner. Further, since both the second speed command signal υhc and the first speed command signal υpc are constantly monitored, it is possible to reliably ascertain the touch position when the upper die 7 comes into contact with the workpiece 9, making it possible to effect switching quickly and reliably.

When position control is selected through switching operation by the position/pressure control switching unit 51, the speed comparing unit 52 has a function to compare the second speed command signal υhc from the position control unit 47 and the die cushion pad speed detection signal υr from the die cushion pad speed computing unit 44, and to output the speed deviation signal ev. When pressure control is selected through switching operation by the position/pressure control switching unit 51, the speed comparing unit 52 has a function to compare the first speed command signal υpc from the pressure control unit 50 with the die cushion pad speed detection signal υr from the die cushion pad speed computing unit 44 to output the speed deviation signal ev.

According to this embodiment, during pressure control, there is output from the pressure control unit 50 the first speed command signal υpc which is of a magnitude corresponding to the pressure deviation signal ep and whose magnitude increases as long as the pressure deviation signal ep exists, so that it is possible to reduce the pressure deviation quickly and reliably. Thus, it is possible to improve the accuracy of the pressure control.

The speed control unit 53 is equipped with a coefficient multiplier 62 inputting the speed deviation signal ev from the speed comparing unit 52 and multiplying the input signal by a predetermined proportional gain K4 before outputting the same, an integrator 63 inputting the speed deviation signal ev from the speed comparing unit 52 and integrating the input signal before outputting the same (the symbol s in the block diagram indicates a Laplace operator), and an coefficient multiplier 64 inputting the output signal from the integrator 63 and multiplying the input signal by a predetermined integral gain K5 before outputting the same, and has a function to add the output signal from the coefficient multiplier 64 to the output signal from the coefficient multiplier 62 to generate/output a motor current command signal (torque command signal) ic.

In the speed control unit 53 also, there is conducted a proportional+integral action (PI action) in which a proportional action (P action) and an integral action (I action) are combined with each other, whereby there is output from the speed control unit 53 a motor current command signal ic which is of a magnitude corresponding to the speed deviation signal ev and whose magnitude increases as long as the speed deviation signal ev exists, and the detection speed is matched with the target speed quickly and accurately. In this way, stable position/pressure control can be effected.

Figure 10:
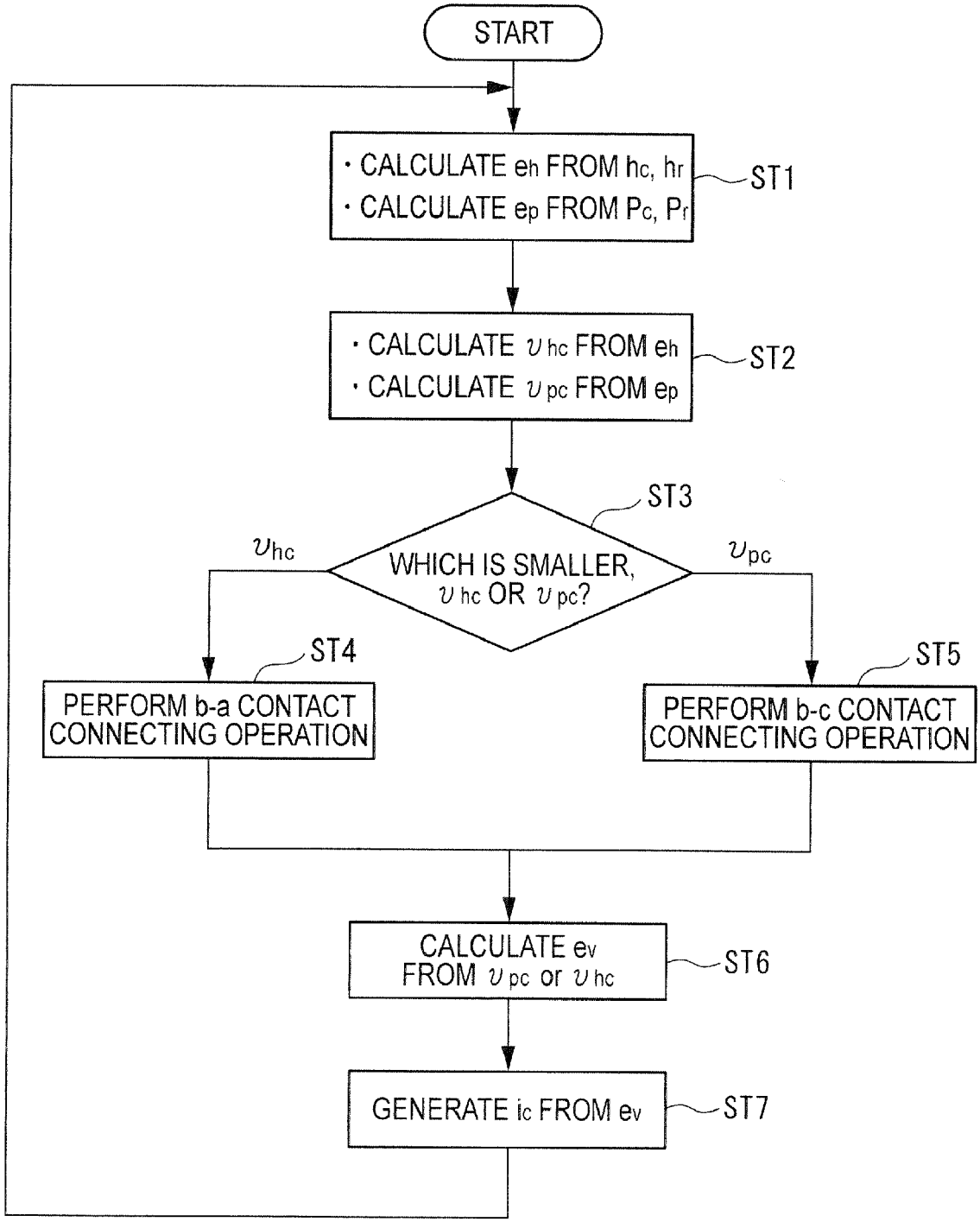
FIG. 10 A flowchart for illustrating the operation of switching between position control and pressure control.

The operation of the controller 41 constituting the die cushion controller 40, constructed as described above, will be briefly described with reference to the operational flowchart of FIG. 10.

ST1: The die cushion pad position computing unit 43 of the controller 41 outputs a die cushion pad position detection signal hr based on the motor rotation angle detection signal θ from the encoder 36 provided on the electric servomotor 21, and the position comparing unit 46 constantly calculates the position deviation signal eh based on the die cushion pad position detection signal hr and the position command signal hc from the position command signal output unit 45. The pressure comparing unit 49 constantly calculates the pressure deviation signal ep based on the pressure detection signal Pr from the pressure gauge 93 and the pressure command signal Pc from the pressure command signal output unit 48.

ST2: The position control unit 47 calculates the second speed command signal υhc based on the position deviation signal eh, and the pressure control unit 50 calculates the first speed command signal υpc based on the pressure deviation signal ep, respectively outputting the signals to the position/pressure control switching unit 51.

ST3: After that, the position/pressure control switching unit 51 selects the smaller one of the second speed command signal υhc and the first speed command signal υpc.

ST4: Further, when it is determined that the second speed command signal υhc is smaller, the position/pressure control switching unit 51 performs b-a contact connecting operation, and outputs the second speed command signal υhc to the speed comparing unit 52 to perform position control.

ST5: In contrast, when it is determined that the first speed command signal υpc is smaller, the position/pressure control switching unit 51 performs b-c contact connecting operation and outputs the first speed command signal υpc to the speed comparing unit 52 to perform pressure control.

ST6: The speed comparing unit 52 calculates the speed deviation signal ev based on the second speed command signal υhc or the first speed command signal υpc, and outputs it to the speed control unit 53.

ST7: The speed control unit 53 generates the motor current command signal ic based on the speed deviation signal ev, and outputs it to the servo amplifier 42.

The servo amplifier 42 is equipped with a current comparing unit 65, a current control unit 66, and a current detecting unit 67. In the servo amplifier 42, the current detecting unit 67 detects the motor current i supplied to the electric servomotor 21, and outputs the detection value as a motor current detection signal ir. The current comparing unit 65 compares the motor current command signal ic from the speed control unit 53 and the motor current detection signal ir from the current detecting unit 67, and outputs a motor current deviation signal ei. The current control unit 66 controls the motor current i to be supplied to the electric servomotor 21 based on the motor current deviation signal ei from the current comparing unit 65.

Figure 11:
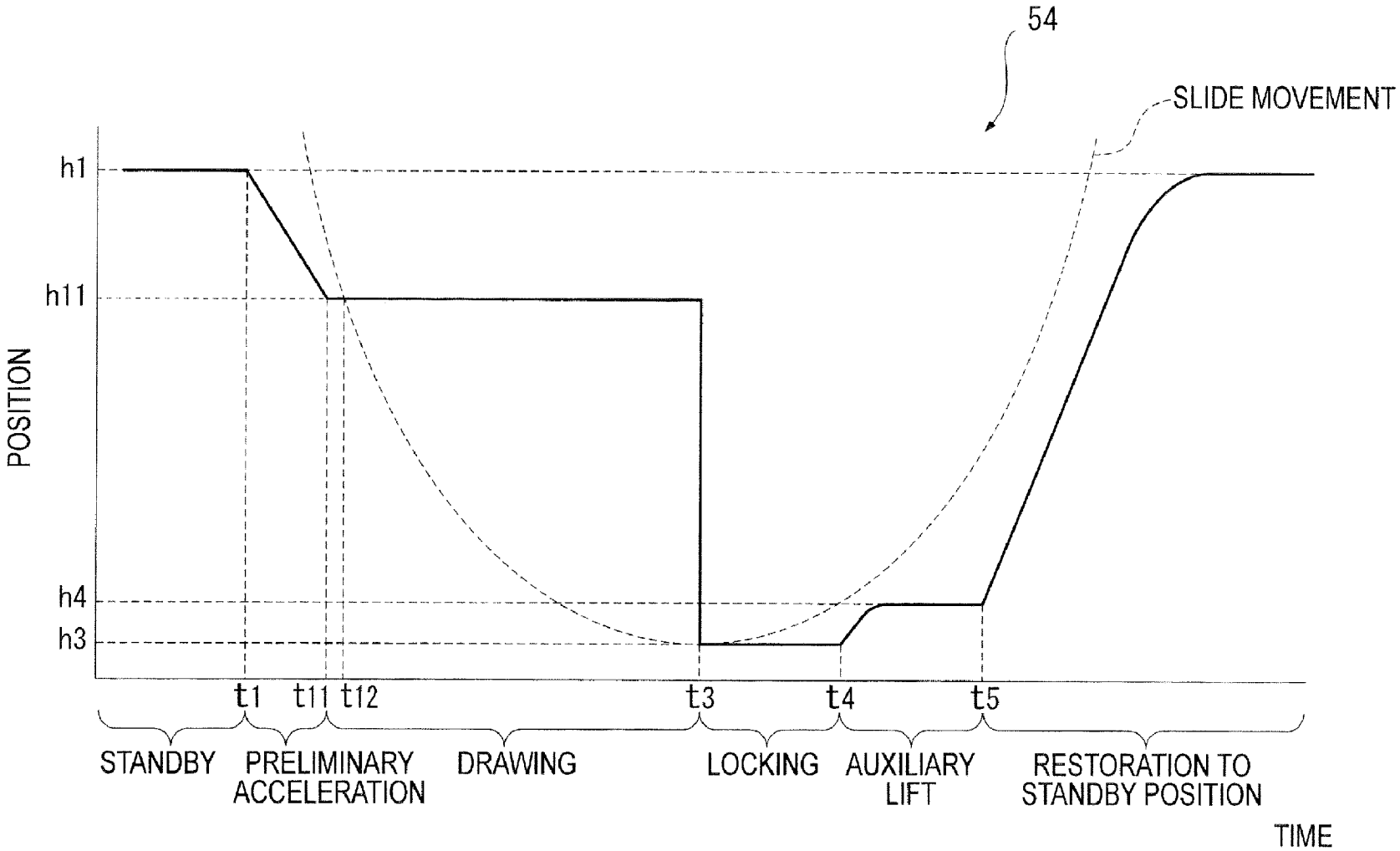
FIG. 11 A diagram showing a positional pattern.
Figure 12:
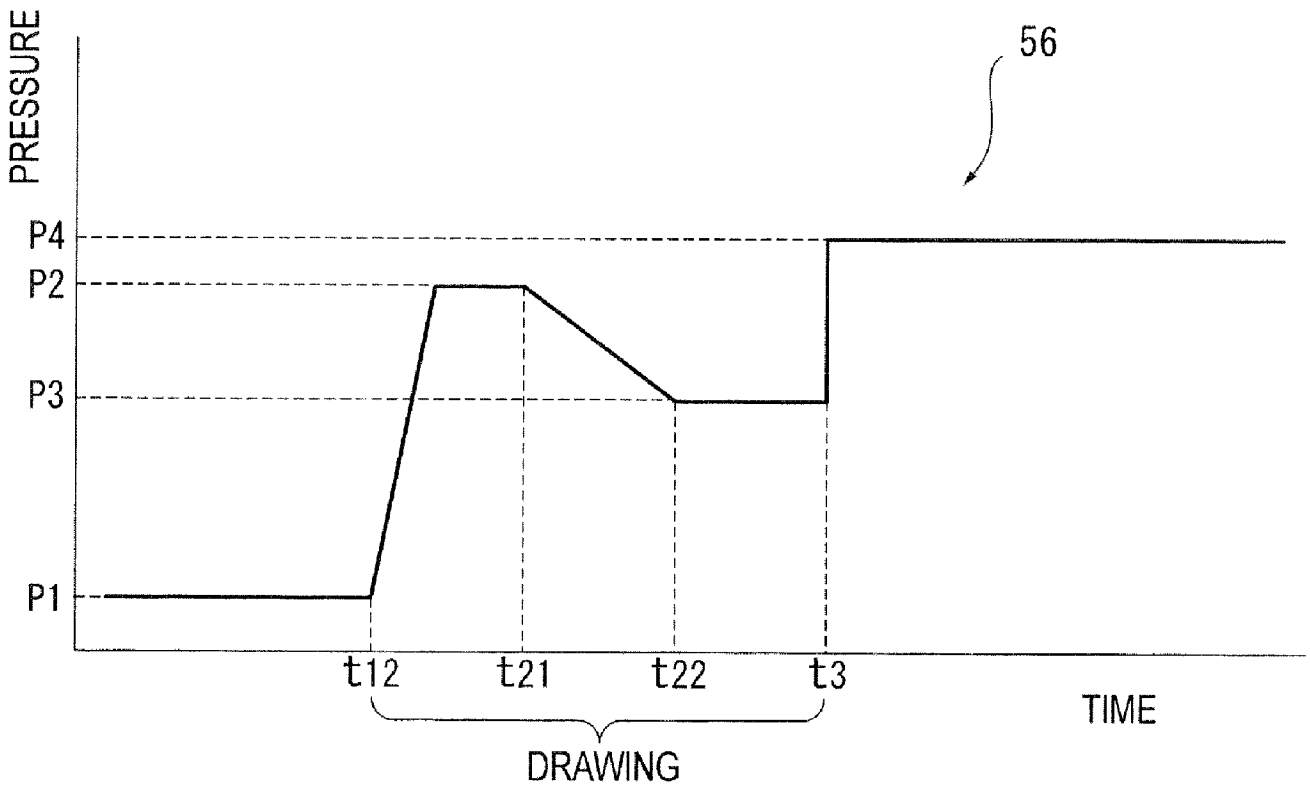
FIG. 12 A diagram showing a pressure pattern.

Here, the positional pattern 54 of the position command signal output unit 45 and the pressure pattern 56 of the pressure command signal output unit 48 of this embodiment will be described in detail. FIG. 11 shows the positional pattern 54 of this embodiment, and FIG. 12 shows the pressure pattern 56 of this embodiment. As shown in FIG. 11, in the positional pattern 54, a position h1 corresponding to the standby position of the die cushion pad 15 is set until time t1. After that, descent is effected to a position h11, which is the position where it is in contact with the slide 4, with a predetermined time constant from time t1 to time t11; it is then set on standby again, and the slide 4 is waited for to come into contact therewith at time t12. When the upper die 7 is in contact with the workpiece 9 to perform drawing, it is desirable for pressure control to be effected, so that the position is set to the fixed position h11 until time t3 when the slide 4 reaches the bottom dead center in order that the position deviation signal eh may increase as the die cushion pad 15 descends together with the slide 4 which is in contact therewith. From the bottom dead center of the slide 4 onward (from time t3 onward), setting is made at time t3 to position h3 corresponding to the position of the bottom dead center of the die cushion pad 15 so that position control may be effected again, and the position h3 is set until time t4 so that the die cushion pad 15 keeps the bottom dead center position for a predetermined period of time. Between time t4 and time t5, an auxiliary lift operation to raise it by a predetermined height is conducted, so that setting is made such that the position h4 is attained at time t5. From time t5 onward, setting is made such that restoration to the position h1 corresponding to the standby position is effected.

As shown in FIG. 12, in the pressure pattern 56, the pressure is set to a predetermined fixed value P1 until time t12 before the upper die 7 comes into contact with the workpiece 9. The predetermined value P1 is set to a value higher by a predetermined ratio than the pre-load of the die cushion pad 15, whereby, in the state before the upper die 7 comes into contact with the workpiece 9, a predetermined pressure deviation signal ep is generated. Next, in the range from time t12 to time t3 in which the upper die 7 is in contact with the workpiece 9 and in which drawing is effected, an optimum pressure is set for each of the predetermined time frames in the pressure pattern 56. More specifically, at the start of drawing, the pressure target value rises obliquely with a predetermined time constant from the predetermined value P1 to a predetermined time P2, keeping the predetermined value P2 until reaching to time t21. After that, from time t21 to time t22, the pressure target value is obliquely lowered with a predetermined time constant from the predetermined value P2 to a predetermined value P3, and the predetermined value P3 is maintained from time t22 to time t3 until the slide 4 reaches the bottom dead center. After the slide 4 has reached the bottom dead center (from time t3 onward), it is desirable to perform position control, so that the pressure target value is set to an sharply high predetermined value P4 in order that the pressure deviation signal ep may increase.

Figure 13:
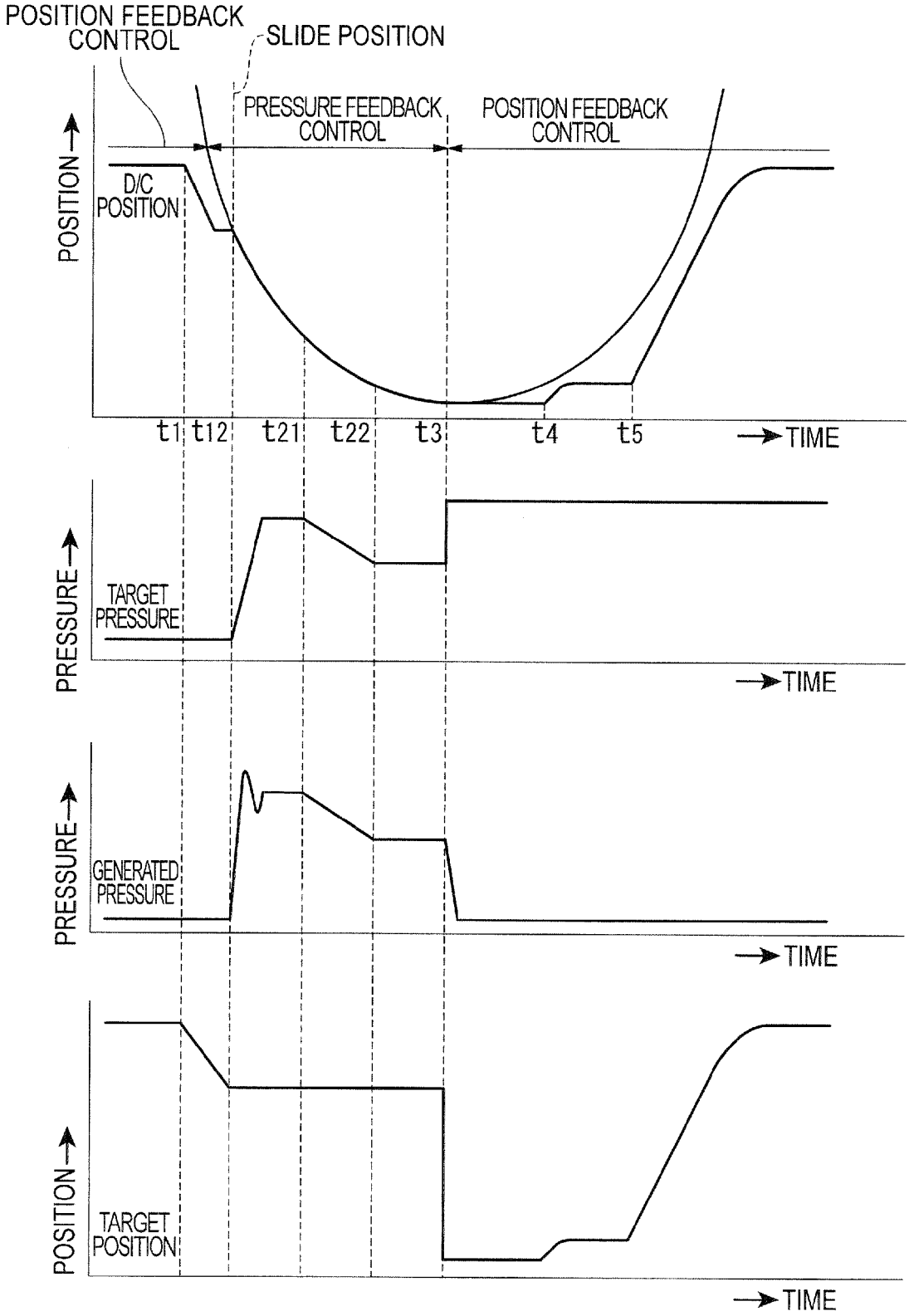
FIG. 13 A diagram illustrating the operation of a slide and a die cushion pad.

Next, the relationship between the operation of the die cushion pad 15 and the pressure/position control will be described in the following. FIG. 13 is a diagram illustrating the operation of the slide 4 and of the die cushion pad 15; the chart indicates how the position of the slide 4 and that of the die cushion pad 15 vary with elapsed time.

In the following description, the die cushion pad position detection signal hr from the die cushion pad position computing unit 43 will be referred to as "position feedback signal hr", the die cushion pad speed detection signal υr from the die cushion pad speed computing unit 44 will be referred to as "speed feedback signal υr", and the pressure detection signal Pr from the pressure gauge 93 will be referred to as "pressure feedback signal Pr". Further, the position control will be referred to as "position feedback control", and the pressure control will be referred to as "pressure feedback control".

First, from the initiation of the press working operation start until time t1, the die cushion pad 15 is at the position h1, which is the standby position, so that the second speed command signal υhc is 0, whereas the first speed command signal υpc becomes corresponding to the predetermined value P1. Thus, from the initiation of the press working operation start until time t1, the position/pressure comparing unit 61 selects the second speed command signal υhc, and the b-contact and the a-contact are connected by the switch 60 to perform position feedback control. Further, also between time t1 and time t12, the first speed command signal υpc becomes corresponding to the predetermined value P1, so that the position feedback control is continued.

During this position feedback control, the position comparing unit 46 subtracts the position feedback signal hr from the position command signal hc to output the position deviation signal eh, the position control unit 47 outputs the second speed command signal υ hc for reducing the position deviation signal eh, the speed comparing unit 52 subtracts the speed feedback signal υr from the second speed command signal υhc to output the speed deviation signal ev, the speed control unit 53 outputs the motor current command signal (torque command signal) ic for reducing the speed deviation signal ev, and the servo amplifier 42 supplies the electric servomotor 21 with the motor current i corresponding to the motor current command signal ic. As a result, the position of the die cushion pad 15 is controlled such that the position detection value obtained by the encoder 36 is in conformity with the preset positional pattern 54. As a result, the die cushion pad 15 is kept on standby at the standby position h1 until time t1, and from time t11 onward, transition is effected to standby at the position h11 where the upper die 7 and the workpiece 9 are in contact with each other.

Next, when, at time t12, the upper die 7 and the workpiece 9 come into contact with each other, the position target value of the positional pattern 54 maintains the predetermined position h11 whereas the die cushion pad 15 descends, so that the position deviation signal eh increases. On the other hand, when the upper die 7 and the workpiece 9 come into contact with each other, an increase in pressure occurs, so that the pressure target value of the pressure pattern 56 approaches the predetermined value P1 which is the pressure target value thereof. Thus, the pressure deviation signal ep is reduced. When the first speed command signal υpc based on the pressure deviation signal ep becomes smaller than the second speed command signal υhc based on the position deviation signal eh, the position/pressure comparing unit 61 selects the first speed command signal υpc. As a result, the b-contact and the c-contact are connected by the switch 60 through b-c contact connecting operation at the position/pressure control switching unit 51, and switching is automatically effected from position feedback control to pressure feedback control. Thus, through automatic switching operation at the position/pressure control switching unit 51, it is possible to reliably effect switching between position control and pressure control immediately after the upper die 7 comes into contact with the workpiece 9.

Thus, from time t2 until time t3, the slide 4 and the die cushion pad 15 descend integrally with each other to perform drawing on the workpiece 9. From time t2 to time t3, pressure feedback control is effected.

During this pressure feedback control, the pressure comparing unit 49 subtracts the pressure feedback signal Pr from the pressure command signal Pc to output the pressure deviation signal ep, the pressure control unit 50 outputs the first speed command signal υpc reducing the pressure deviation signal ep, the speed comparing unit 52 subtracts the speed feedback signal υr from the first speed command signal υpc to output the speed deviation signal ev, the speed control unit 53 outputs the motor current command signal (torque command signal) ic reducing the speed deviation signal ev, and the servo amplifier 42 supplies the electric servomotor 21 with the motor current i corresponding to the motor current command signal ic. As a result, the cushion pressure of the die cushion pad 15 is controlled such that the pressure detection value obtained by the pressure gauge 93 is in conformity with the preset pressure pattern 56.

Next, at time t3, when the slide 4 and the die cushion pad 15 reach the bottom dead center, the pressure target value of the pressure pattern 56 sharply increases to the predetermined value P4, so that the pressure deviation signal ep increases, whereas the position target value of the positional pattern 54 attains the position h3 corresponding to the bottom dead center, so that the position deviation signal eh decreases. As a result, the second speed command signal υhc based on the position deviation signal eh becomes smaller than the first speed command signal υpc based on the pressure deviation signal ep, and the position/pressure comparing unit 61 selects the second speed command signal υhc. Thus, the b-contact and the a-contact are connected by the switch 60 through b-a contact connecting operation at the position/pressure control switching unit 51, and switching is automatically effected from pressure feedback control to position feedback control.

From time t3 until time t4, the die cushion pad 15 is locked at the position h3, and the ascending movement is temporarily stopped. From time t4 until time t5, the die cushion pad 15 ascends by an amount corresponding to an auxiliary lift. At time t5, the die cushion pad 15 restarts ascending movement to be restored to the standby position h1 before stopping. From time t3 onwards, position feedback control is effected, and the position of the die cushion pad 15 is controlled through the various signal flows as described above such that the position detection value obtained by the encoder 36 is in conformity with the preset positional pattern 54.

Second Embodiment

Figure 14:
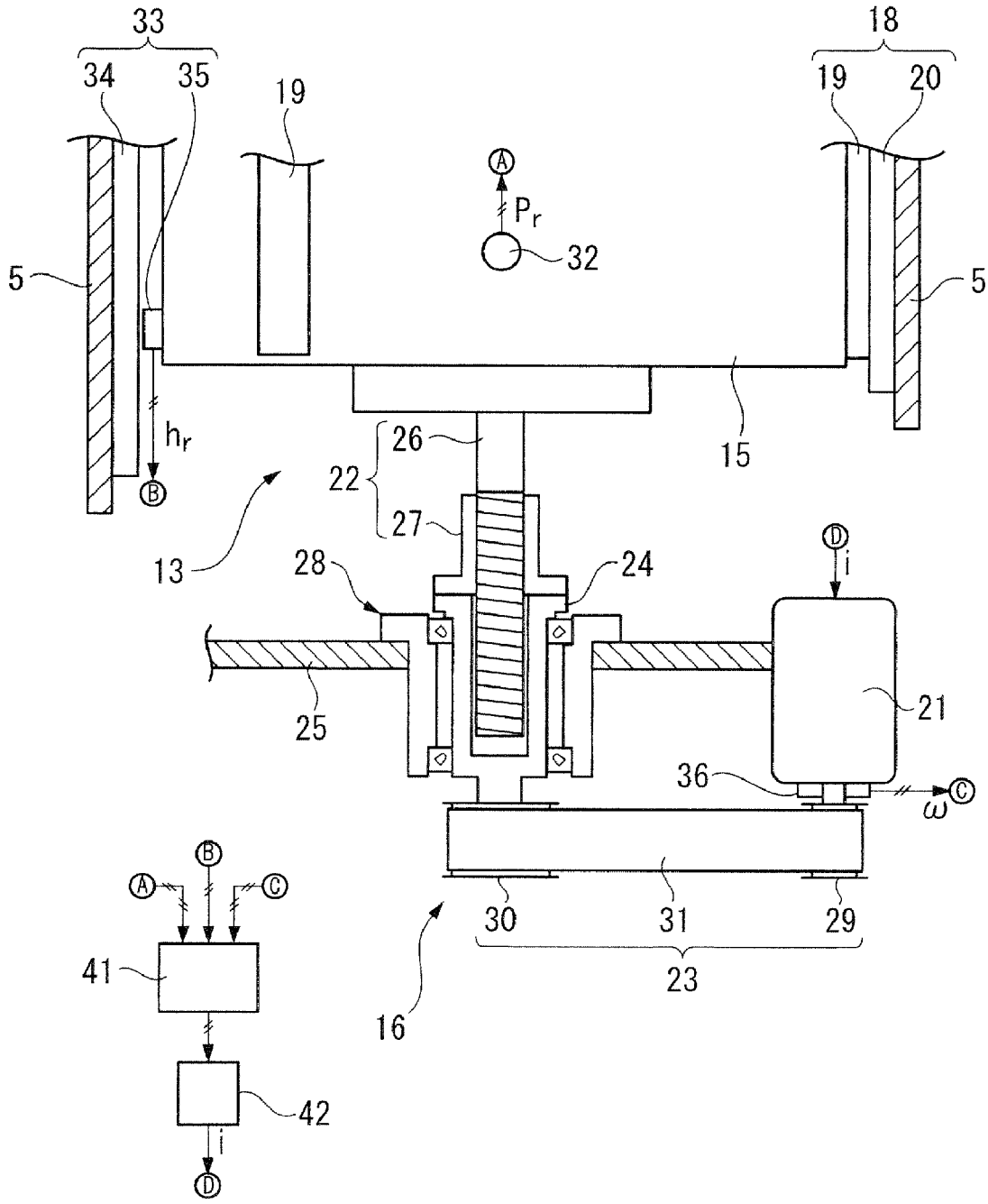
FIG. 14 A schematic structural view of a die cushion according to a second embodiment of the present invention.
Figure 15:
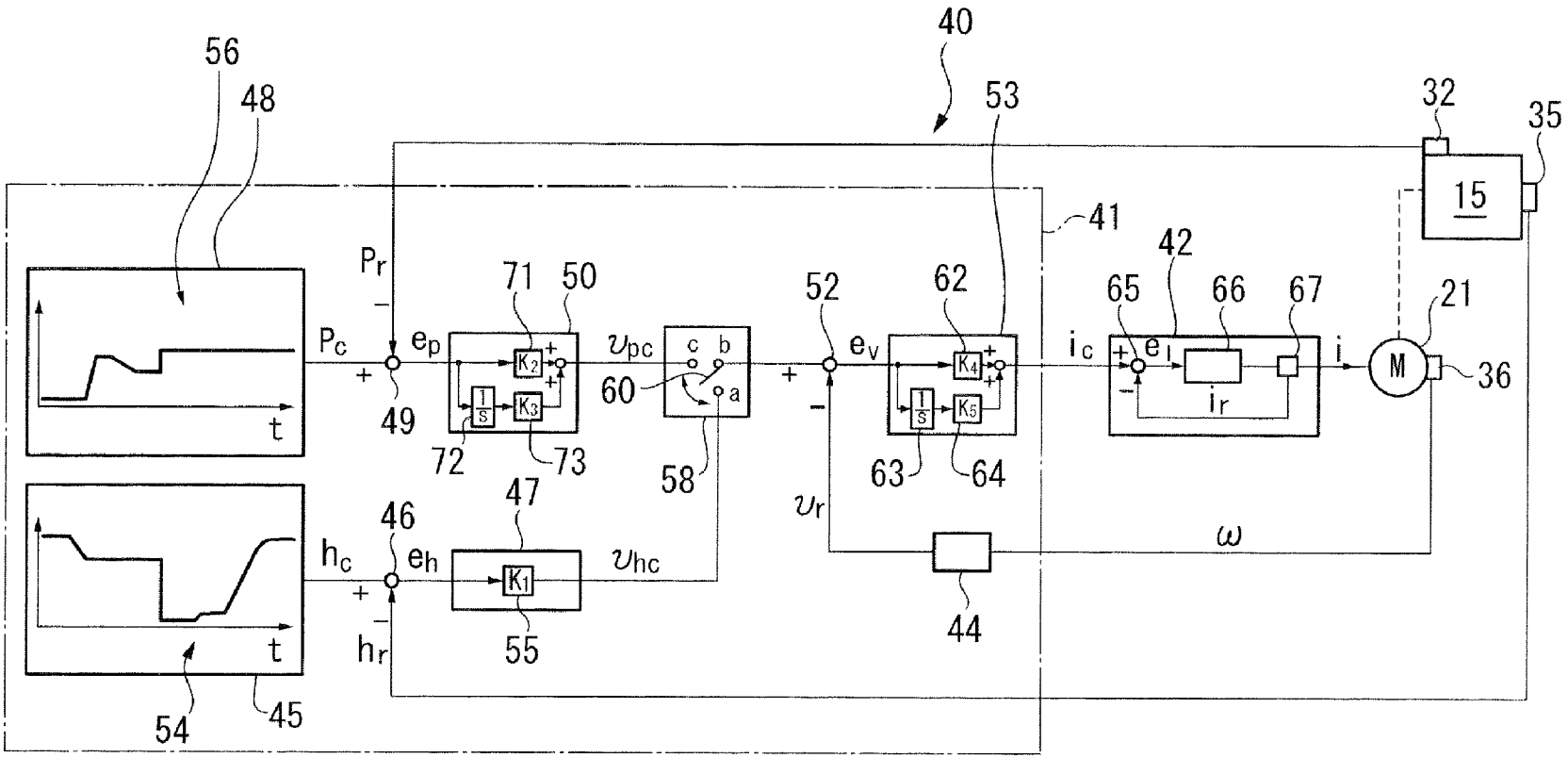
FIG. 15 A block diagram illustrating a construction of a die cushion controller according to the second embodiment.

FIG. 14 is a schematic structural view of a die cushion according to a second embodiment of the present invention. FIG. 15 is a block diagram illustrating the construction of the die cushion controller of this embodiment. In this embodiment, the components that are the same as or similar to those of the first embodiment are indicated by the same reference numerals and a detailed description thereof will be omitted. The following description will center on the differences between the first and second embodiments.

In the die cushion 13 of this embodiment, the upper end portion of the screw portion 26 of the ball screw mechanism 22 is connected with the lower end portion of the die cushion pad 15, and the plunger rod 80 forming the hydraulic chamber 83 as in the first embodiment, the hydraulic circuit that supplies pressure oil to the pressure chamber 83, etc. are not provided. The pressure gauge 93 is neither provided. Thus, a strain gauge (pressure detecting means) 32 is attached to a lateral side of the die cushion pad 15, and the strain gauge 32 detects the load generated in the die cushion pad 15, that is, the cushion pressure, and outputs the detection value to the controller 41 as the pressure detection signal Pr.

Further, between the die cushion pad 15 and the bed 5, there is provided a linear scale (position detecting means) 33 that detects the position of the die cushion pad 15. The linear scale 33 is constructed of a scale portion 34 and a head portion 35. The scale portion 34 is attached to a predetermined position of the inner wall surface of the bed 5, and the head portion 35 is attached to a lateral side of the die cushion pad 15 so as to be close to the scale portion 34, with the head portion 35 moving along the scale portion 34 as the die cushion pad 15 ascends and descends.

The head portion 35 outputs a die cushion pad position detection signal hr corresponding to the position of the die cushion pad 15. The die cushion pad position detection signal hr output from the head portion 35 is input to the controller 41. Thus, according to this embodiment, no motor rotation angle detection signal θ is output from the encoder 36 provided to the electric servomotor 21 as in the first embodiment, and only the motor rotation angular velocity detection signal to is output, which is input to the controller 41.

The pressure pattern 56, etc. used in pressure feedback control are the same as that of the first embodiment, and this embodiment can also provide the same effects as those of the first embodiment.

The present invention is not restricted to the above-mentioned embodiments but covers other constructions or the like as long as the object of the present invention can be achieved, and the following modifications, etc. are also covered by the present invention.

Figure 16:
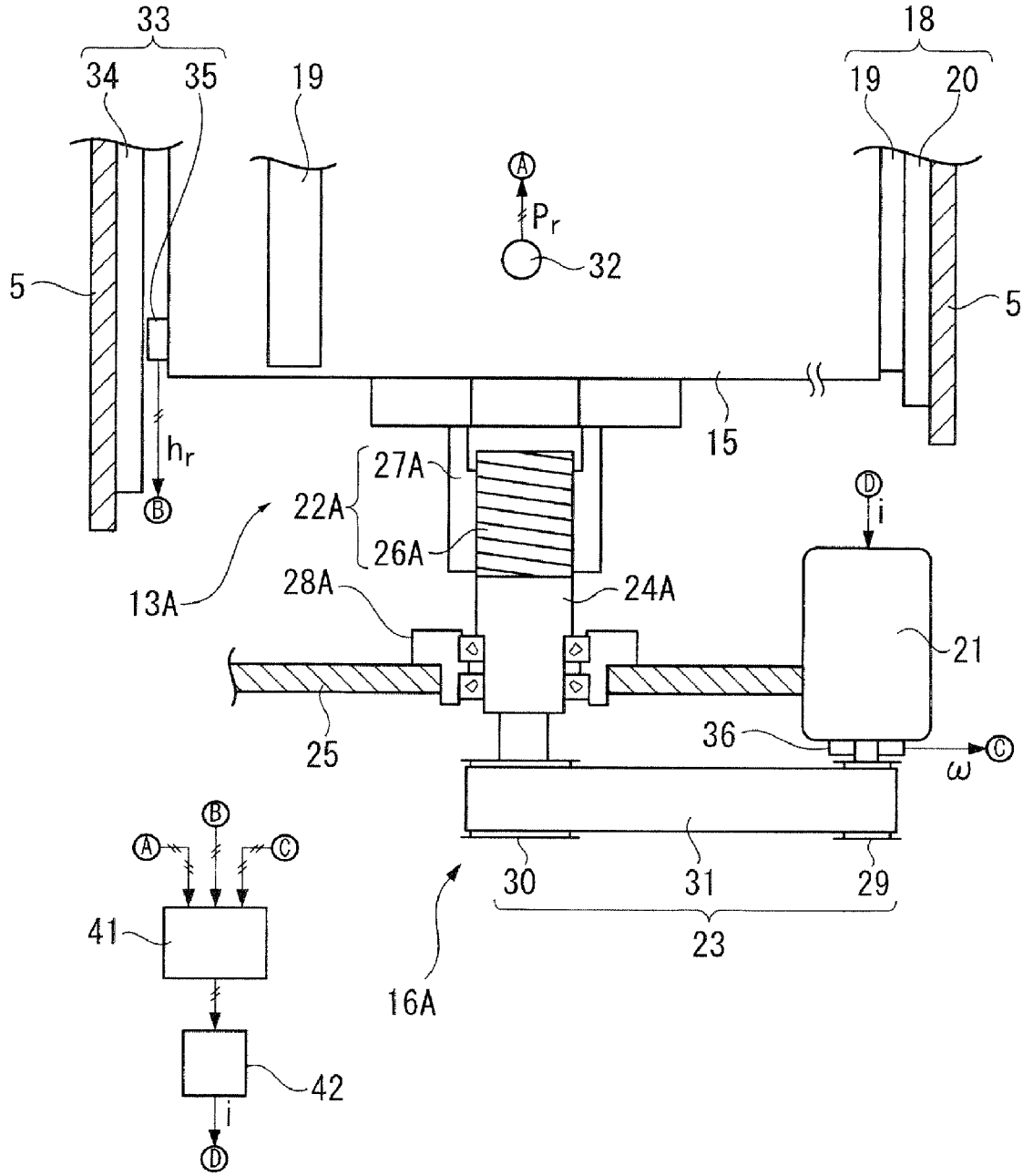
FIG. 16 A diagram illustrating a first modification of the die cushion.

For example, instead of the die cushion 13 of the above-mentioned embodiments, it is also possible to adopt a die cushion 13A as shown in FIG. 16 (in which the components that are the same as or similar to those of the die cushion 13 are indicated by the same reference numerals) (first modification). In a die cushion pad driving mechanism 16A of the die cushion 13A, a nut portion 27A of a ball screw mechanism 22A is connected to the lower end portion of the die cushion pad 15, and a screw portion 26A threaded with the nut portion 27A is connected to the large pulley 30 through a connecting member 24A. The rest of the arrangement of the die cushion of this modification is the same as the die cushion 13 of the second embodiment.

Figure 17:
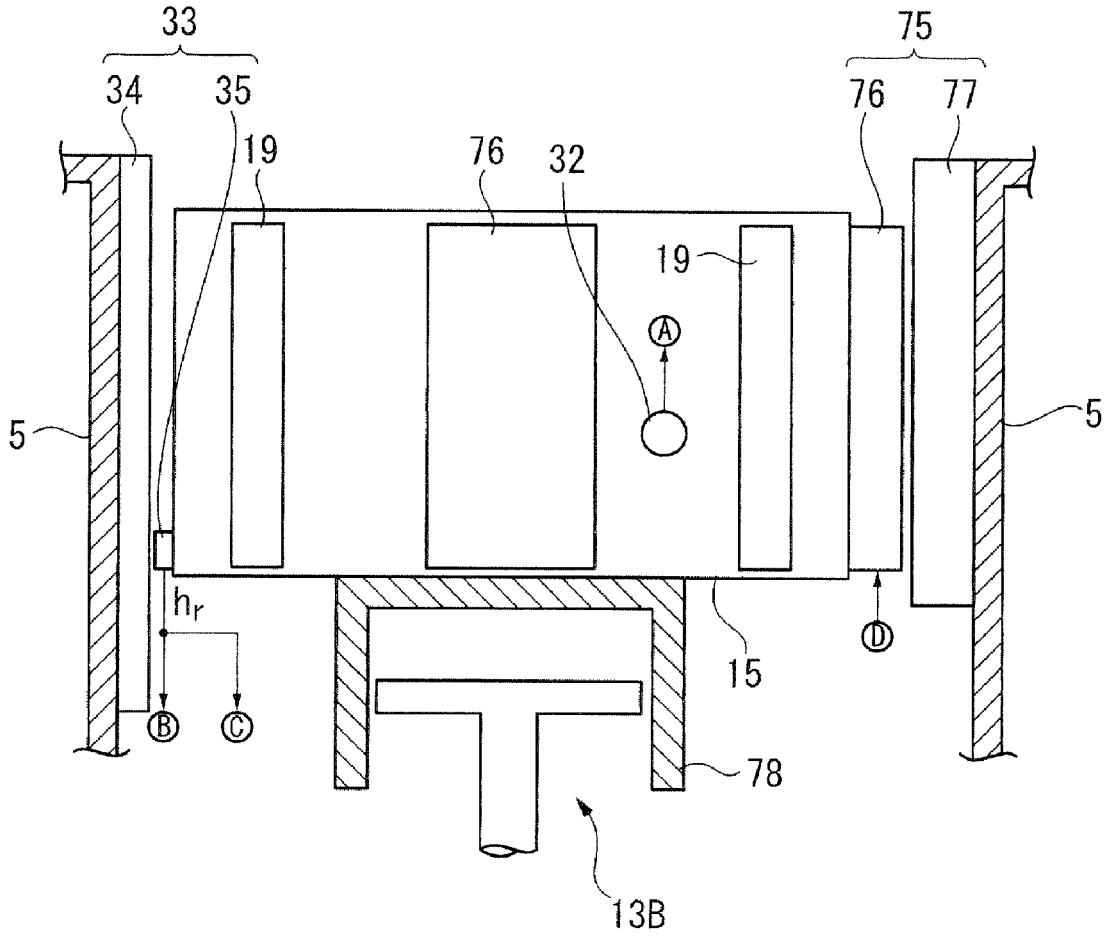
FIG. 17 A diagram illustrating a second modification of the die cushion.
Figure 17:
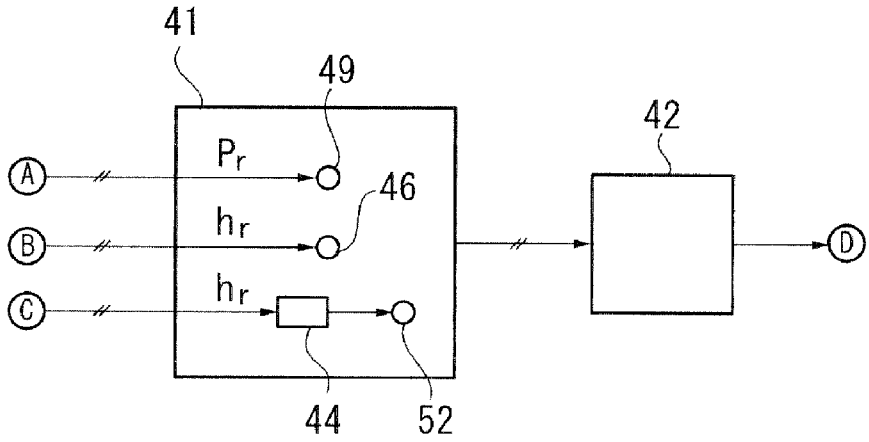
Figure 18:
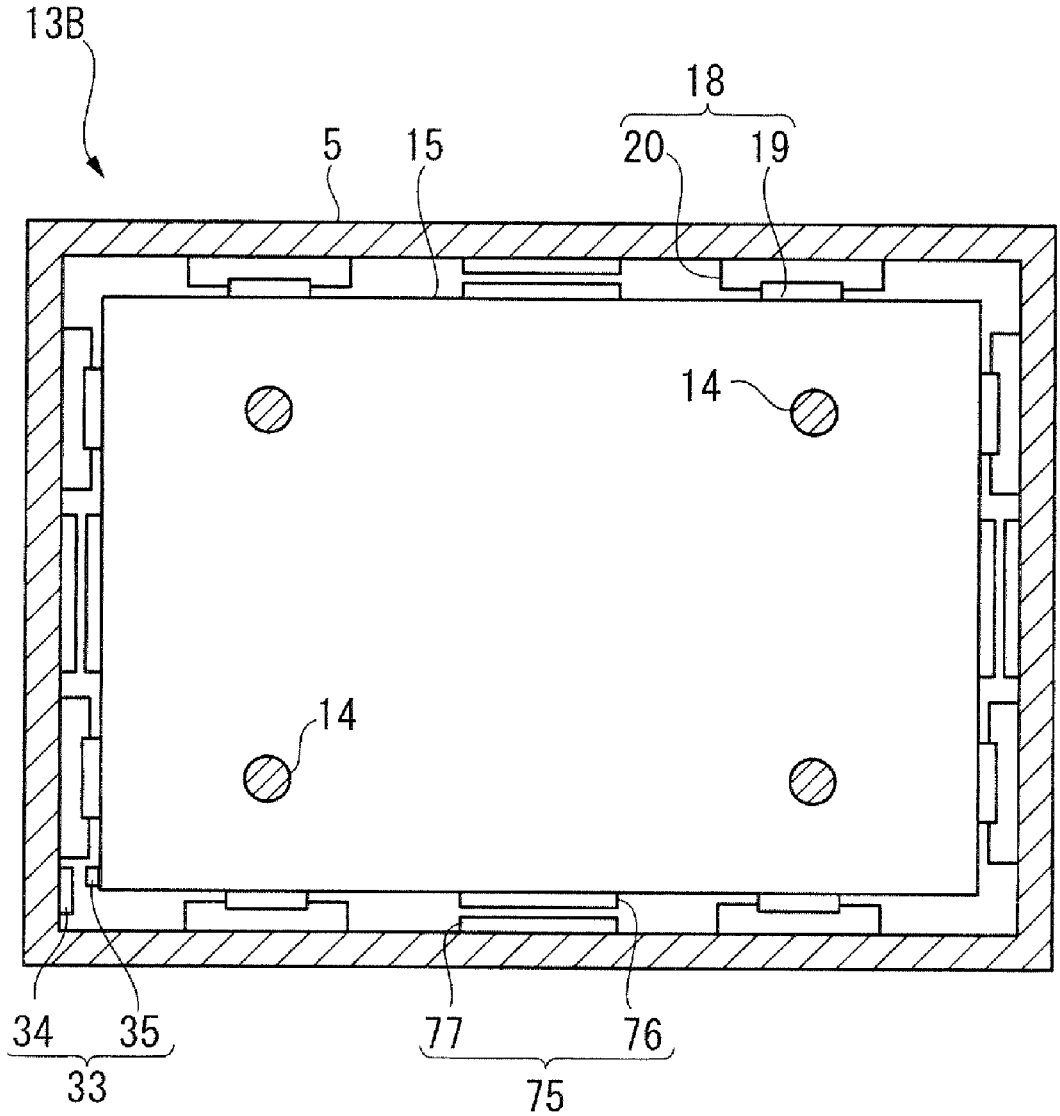
FIG. 18 A diagram illustrating another part of the second modification.

Further, instead of the die cushion 13 of the above-mentioned embodiments, it is also possible to adopt a die cushion 13B as shown in FIGS. 17 and 18 (in which the components that are the same as or similar to those of the die cushion 13 are indicated by the same reference numerals) (second modification). In the die cushion 13B, a linear servomotor (electric servomotor) 75 is provided between each lateral side of the die cushion pad 15 and the inner wall surface of the bed 5 opposed thereto. The linear servomotor 75 is constructed of a pair of coil portion 76 and magnet portion 77. The coil portion 76 is provided on each lateral side of the die cushion pad 15, and the magnet portion 77 is provided to the inner wall surface of the bed 5. Conversely, it is also possible to provide the magnet portion 77 on each lateral side of the die cushion pad 15, and to provide the coil portion 76 to the inner wall surface of the bed 5.

In the die cushion 13B, in the case in which the coil portions 76 are provided to the die cushion pad 15, when the coil portions 76 are excited, an attractive force and a repulsive force are exerted between the coil portions 76 and the magnet portions 77, so that the coil portions 76 and the die cushion pad 15 receives an urging force in the ascending/descending direction. In the case in which the magnet portions 77 are provided to the die cushion pad 15, when the coil portions 76 are excited, an attractive force and a repulsive force are exerted between the coil portions 76 and the magnet portions 77, so that the magnet portions 77 and the die cushion pad 15 receives an urging force in the ascending/descending direction. When the supply current to the coil portions 76 is controlled, the urging force imparted to the die cushion pad 15, i.e. the cushion pressure generated in the die cushion pad 15, is controlled.

In the die cushion 13B, there is provided under the die cushion pad 15 a pneumatic balancer 78 constructed of a piston and a cylinder. Although not shown, the lower portion of the piston of the balancer 78 is supported by the beam 25 (FIG. 1). In this way, the die cushion pad 15 is supported by the beam 25 through the balancer 78, so that if the power source of the linear servomotor 75 is cut off and the magnetic force between the coil portions 76 and the magnet portions 77 ceases to exist, there is no fear of the die cushion pad 15 falling therefrom.

The control system for the die cushion 13B basically allows application of the die cushion controller 40. However, due to the structural differences between the rotary servomotor and the linear servomotor, there are some differences in motor speed feedback control system. Specifically, the die cushion pad speed computing unit 44 of this modification inputs the die cushion pad position detection signal hr from the head portion 35 of the linear scale 33 for detecting the die cushion pad position, and differentiates the input signal with respect to time to obtain the speed of the die cushion pad 15, outputting the result to the speed comparing unit 52 as the die cushion pad speed detection signal υr.

According to the die cushion 13B, the power transmission between the linear servomotor 75 and the die cushion pad 15 is effected not through mechanical contact using engagement members such as gears, belt, and ball screw but in a non-contact fashion using magnetic force, so that the mechanical noise during the power transmission can be considerably reduced. Further, as compared with the case in which the rotary servomotor is used, the number of components is reduced, thereby facilitating the maintenance.

While in the above-mentioned embodiments pressure control is effected in the time section between time t2 and time t3, during which drawing is actually performed, and position control is effected in the other time sections, it is also possible to effect pressure control in the other time sections. In this case also, the switching between position control and pressure control can be effected in a satisfactory manner by appropriately setting the pressure pattern and the positional pattern.

Further, while in the above embodiments the automatic switching between pressure control and position control is effected when drawing is started and when the slide reaches the bottom dead center, it is not necessary for the automatic switching to be effected in all the range of press drawing time. For example, when drawing is started, it is possible to effect the automatic switching by the position/pressure control switching unit, and to forcibly effect switching to position control when the slide reaches the bottom dead center through time control.

Figure 19:
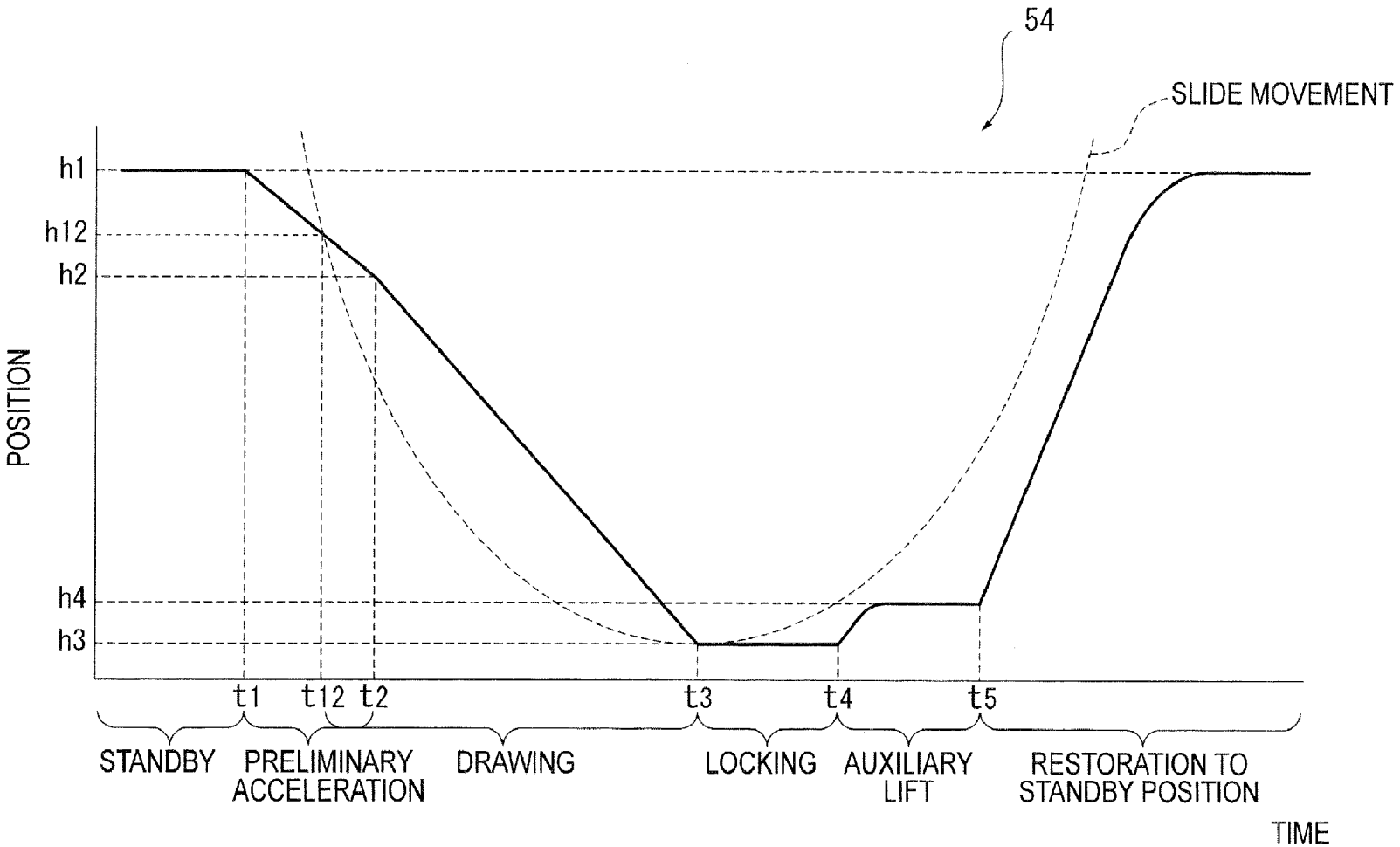
FIG. 19 A diagram showing a positional pattern of a third modification.

FIG. 19 shows the positional pattern 54 according to a third modification of the present invention. This modification differs from the above embodiments in that the die cushion pad 15 is lowered to perform preliminary acceleration in the time section from time t1, when the die cushion pad is at the standby position h1, to time t2, which corresponds to the position h2. Actually, in this case, the upper die 7 comes into contact with the workpiece 9 at time t12, when the workpiece 9 is descending. By performing this preliminary acceleration, it is possible to reduce the impact generated when the upper die 7 comes into contact with the workpiece 9, making it possible to perform drawing with high precision. The positional pattern 54 shown in FIG. 19 is set such that the die cushion pad 15 moves toward the bottom dead center position in the time section from time t2 to time t3.

Figure 20:
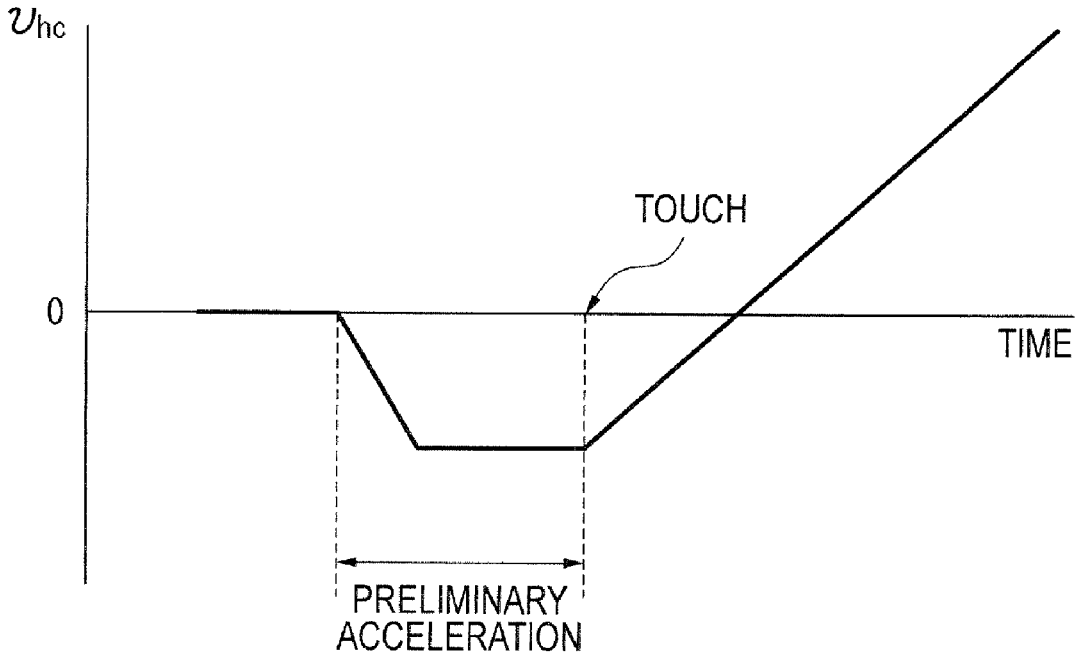
FIG. 20 A diagram showing the relationship between time and a second speed command signal in the third modification.

FIG. 20 shows the second speed command signal υhc output when such preliminary acceleration is effected. The first speed command signal υpc is the same as that in the above-mentioned embodiment. In FIG. 20, the second speed command signal υhc of this modification generated based on the positional pattern 54 is lowered from the position of the standby state at a predetermined time constant, and is then maintained at a fixed value because the die cushion pad 15 is lowered at a predetermined acceleration, and is then lowered at a fixed speed. After the touch position is reached halfway through the preliminary acceleration, the die cushion pad 15 actually descends together with the slide 4, and, at the same time, the positional pattern 54 is set at a position higher than the actual die cushion pad 15, so that the position deviation signal eh gradually increases, and in accordance therewith, the second speed command signal υhc also increases.

Figure 21:
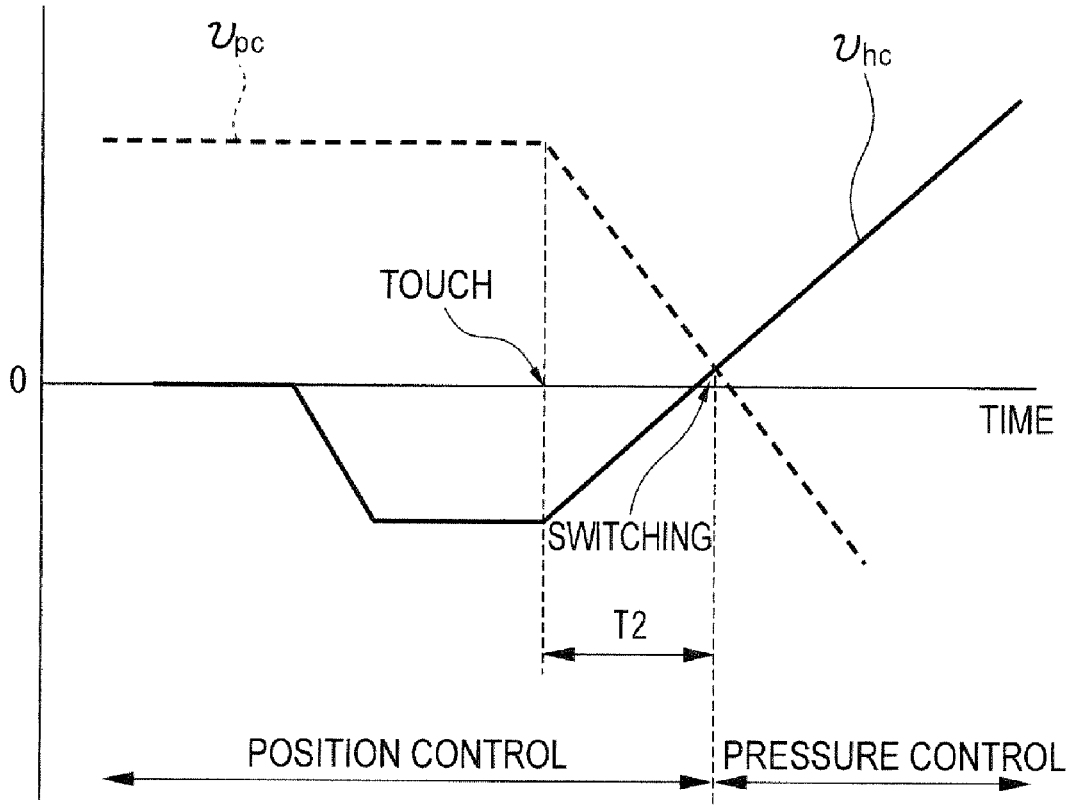
FIG. 21 An explanatory view for illustrating an operation of switching between position control and pressure control in the third modification.

FIG. 21 shows the relationship between such a second speed command signal υhc output and the first speed command signal υpc. The operation of switching between position control and pressure control will be described with reference to this drawing. In this modification as compared with the above embodiment, due to the preliminary acceleration effected, the touch position is reached when the second speed command signal υhc is at a smaller value. Thus, the second speed command signal υhc is turned upward when it is of a value much smaller than the first speed command signal υpc, and it takes a time T2 that is longer than that in the above embodiment before the magnitude relationship between the second speed command signal υhc and the first speed command signal υpc is reversed from the touch position onward. That is, while there is involved some delay until the switching between position control and pressure control is effected after the touch position, an improvement in quality is to be expected due to preliminary acceleration.

Figure 22:
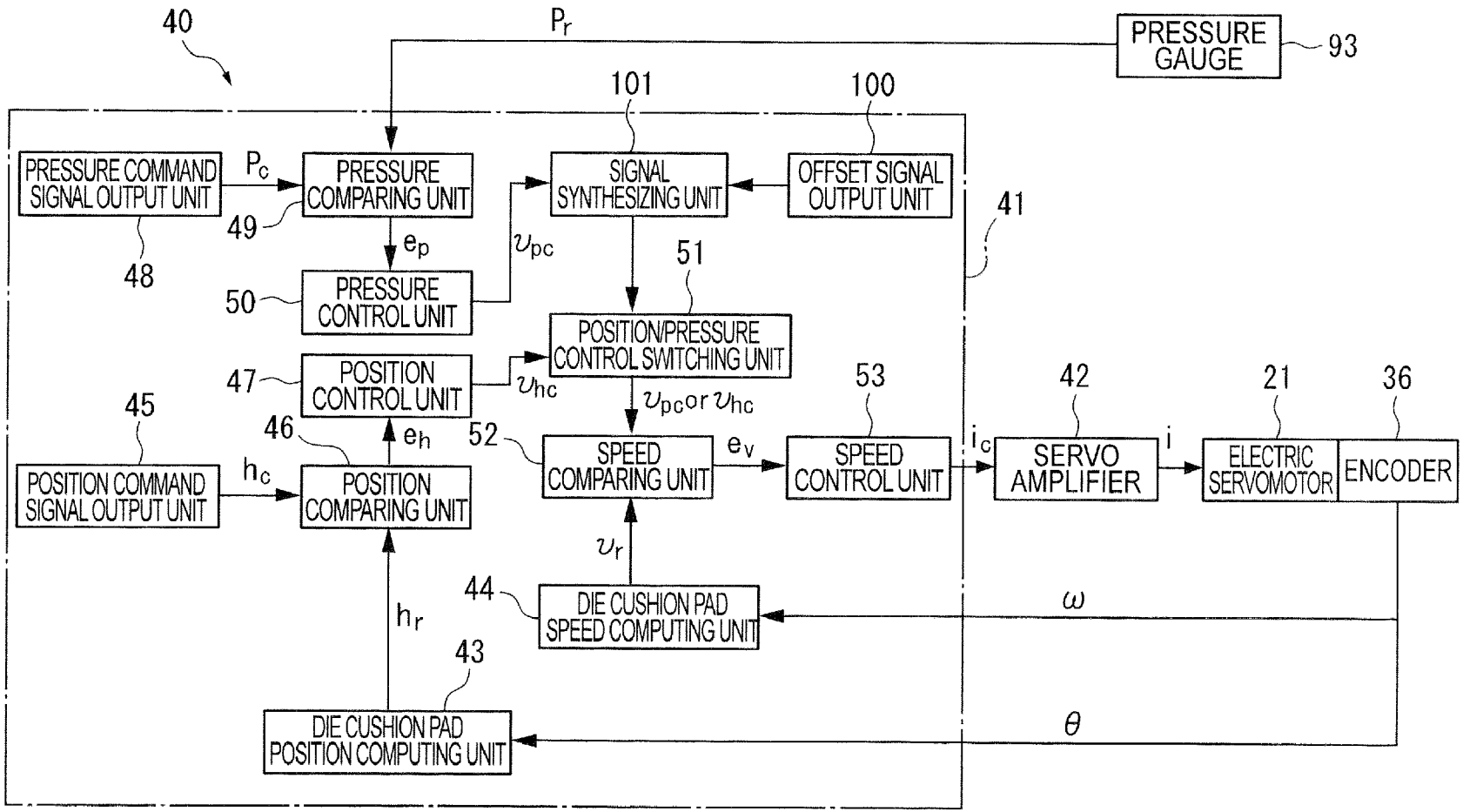
FIG. 22 A functional block diagram illustrating a die cushion controller according to a fourth modification.
Figure 23:
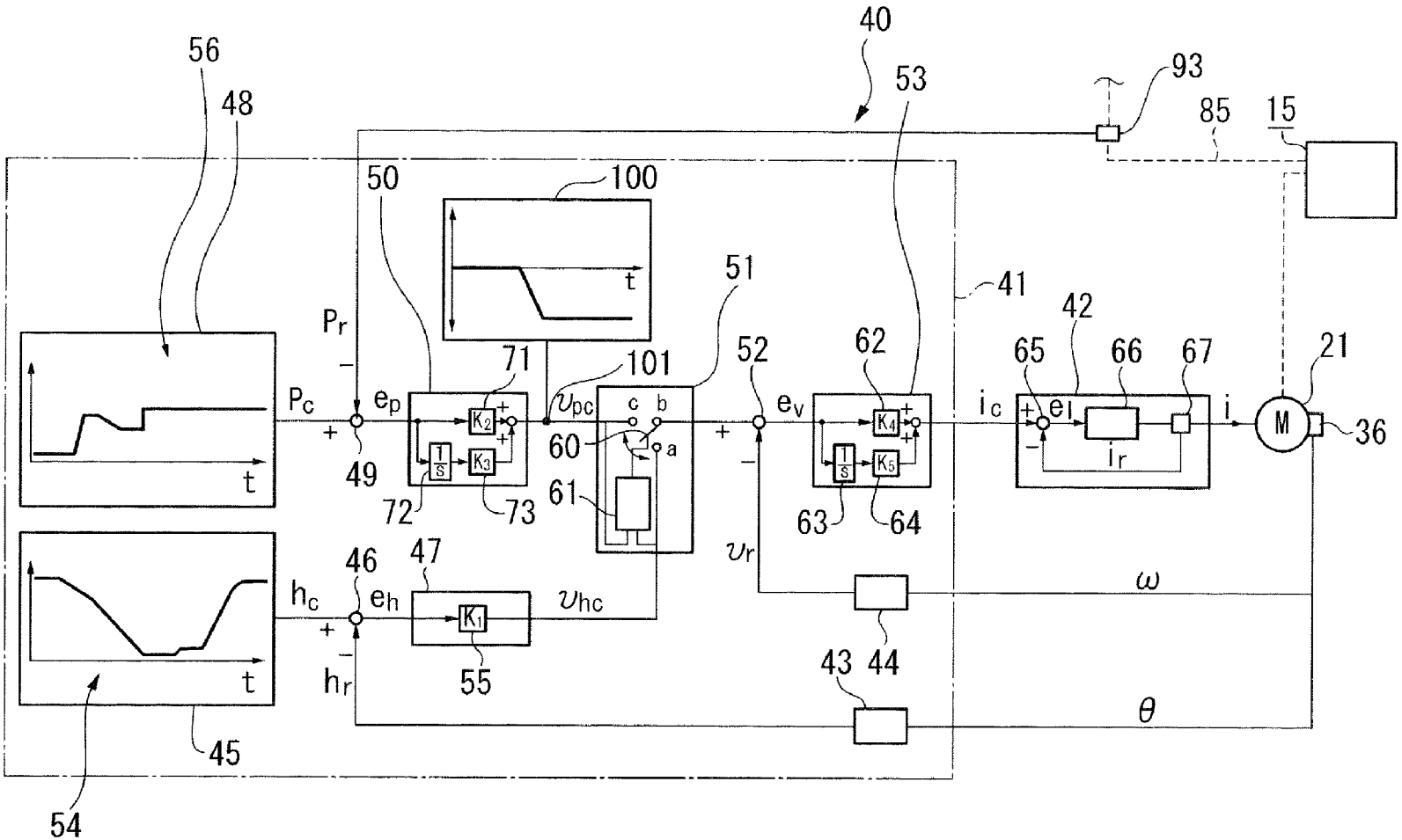
FIG. 23 A control block diagram illustrating the die cushion controller of the fourth modification.

As shown in a functional block diagram of FIG. 22 and a control block diagram of FIG. 23, in a fourth modification of the present invention, the controller 41 is equipped with an offset signal output unit 100 and a signal synthesizing unit 101. In the offset signal output unit 100 and the signal synthesizing unit 101, the first speed command signal υpc is corrected even when the die cushion pad 15 undergoes preliminary acceleration, whereby the switching between position control and pressure control is effected without delay after the touch.

Figure 24:
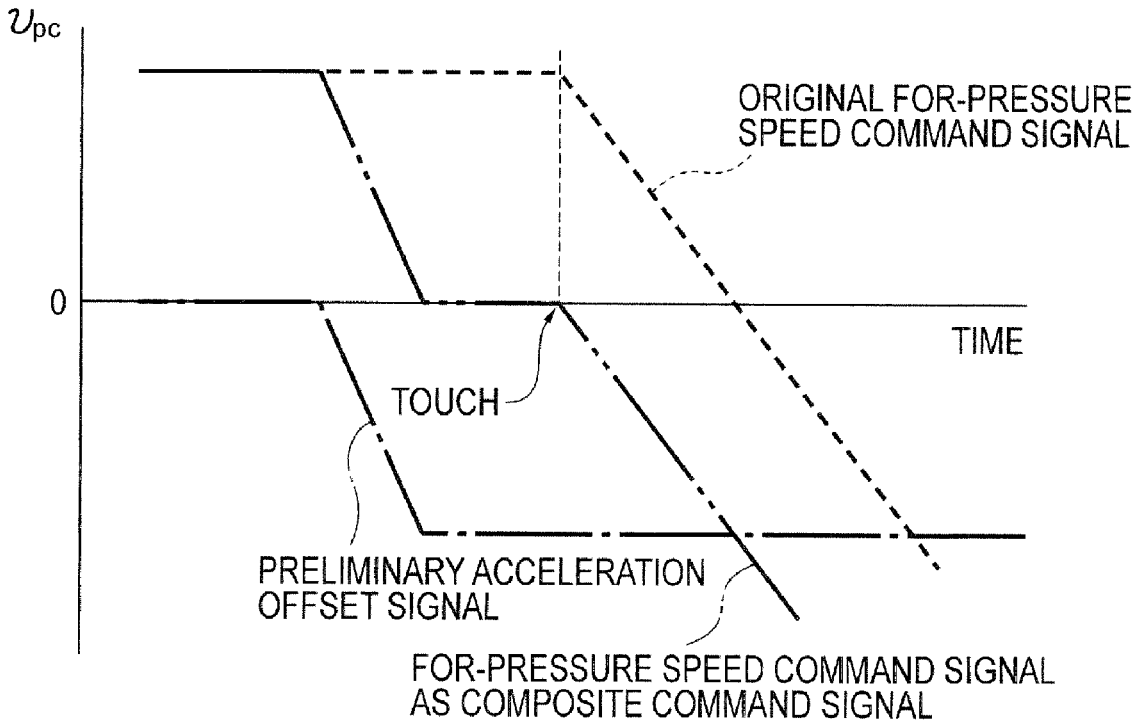
FIG. 24 An explanatory view showing a relationship between time and a first speed command signal in the fourth modification.

More specifically, the offset signal output unit 100 has a function to generate a preliminary acceleration offset signal shown in FIG. 24 and to output it to the signal synthesizing unit 101.

The signal synthesizing unit 101 synthesizes the original first speed command signal υpc output from the pressure control unit 50 with a preliminary acceleration offset signal from the offset signal output unit 100, and outputs the synthesized composite command signal to the position/pressure control switching unit 51 as the first speed command signal υpc.

Figure 25:
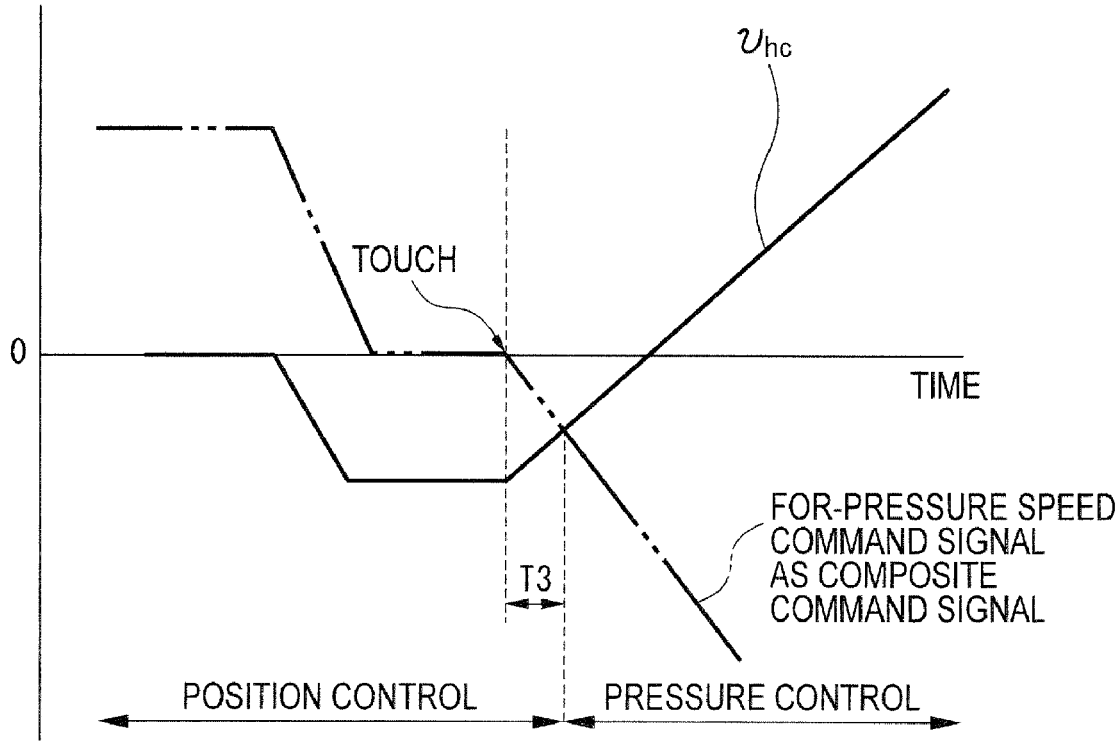
FIG. 25 An explanatory view for illustrating the operation of switching between position control and pressure control in the fourth modification.

FIG. 25 shows the relationship between the synthesized first speed command signal υpc output and the second speed command signal υhc. Since preliminary acceleration is effected, the second speed command signal υhc is the same as that of the third modification described above. As is apparent from FIG. 25, when the synthesized first speed command signal υpc is output, the value of the first speed command signal υpc at the touch position is small, so that it is further diminished after the touch. As a result, the first speed command signal υpc crosses the second speed command signal υhc in a short time T3. Thus, while the time T2 elapsed until the switching from position control to pressure control after the touch is large due to preliminary acceleration in the above-mentioned third modification, in this modification, even if preliminary acceleration is effected, the time required for the switching can be reduced to T3, and rebound or the like of the workpiece 9 immediately after the touch is effectively prevented, making it possible to provide a drawing of a still higher precision.

Figure 26:
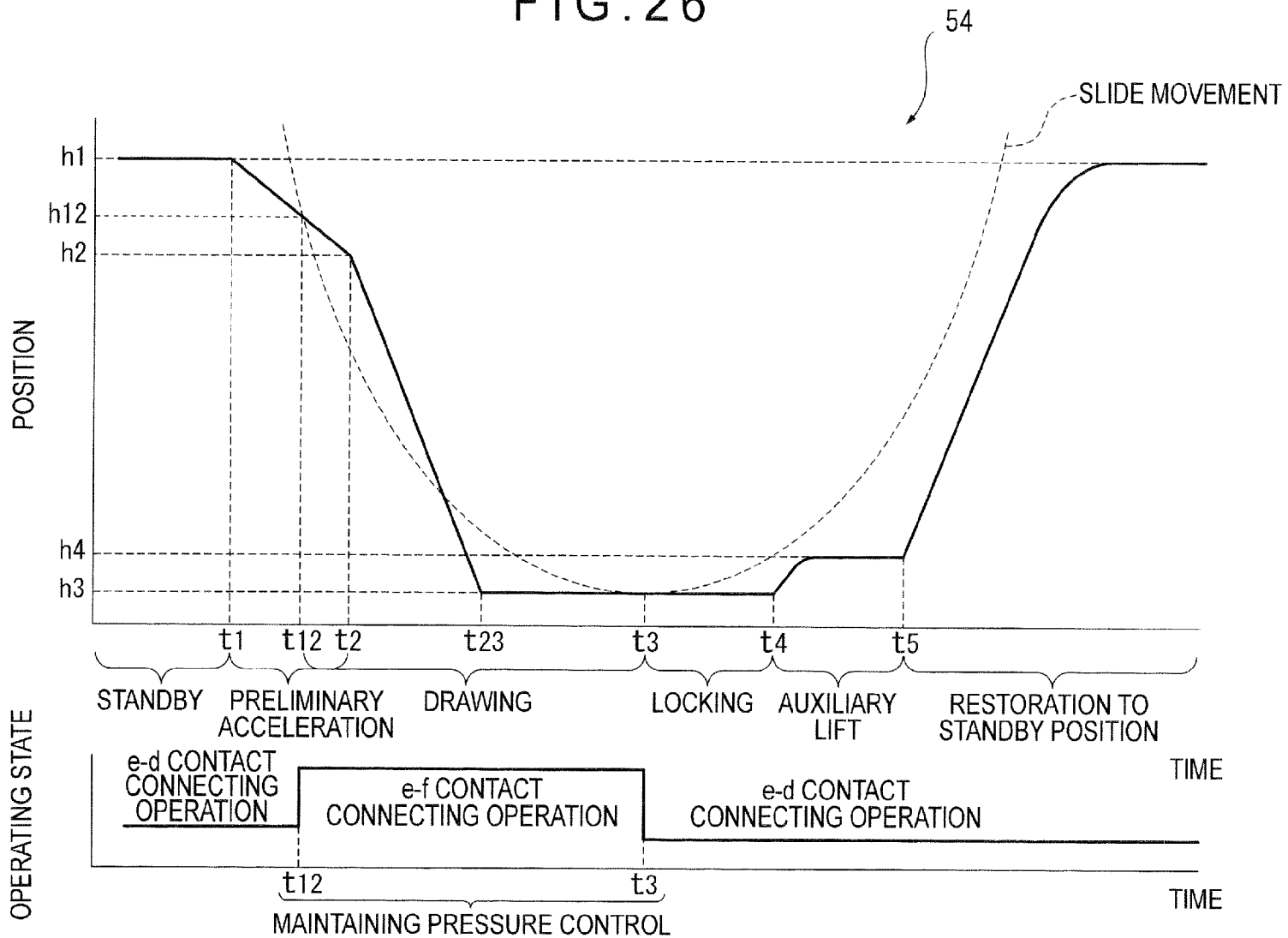
FIG. 26 A diagram showing a positional pattern in a fifth modification.

In the following, a fifth modification of the present invention will be described. As shown in FIG. 19, in the positional pattern 54 of the above-mentioned third modification, the position target is set such that, after the completion of preliminary acceleration at time t2, the die cushion pad 15 also heads for its own bottom dead center position so as to be in conformity with time t3 at which the slide 4 reaches to the bottom dead center position. After the bottom dead center position has been reached, bottom dead center locking is effected on the die cushion pad 15. In this regard, in order to reliably effect the bottom dead center locking, it is desirable for the position target of the die cushion pad 15 to be the bottom dead center position at a relatively early time t23 as shown in FIG. 26. However, in the positional pattern 54 shown in FIG. 26, the position target becomes smaller than the actual position of the die cushion pad 15 before the bottom dead center position has been reached, and there is a fear of switching to position control during pressure control.

Figure 27:
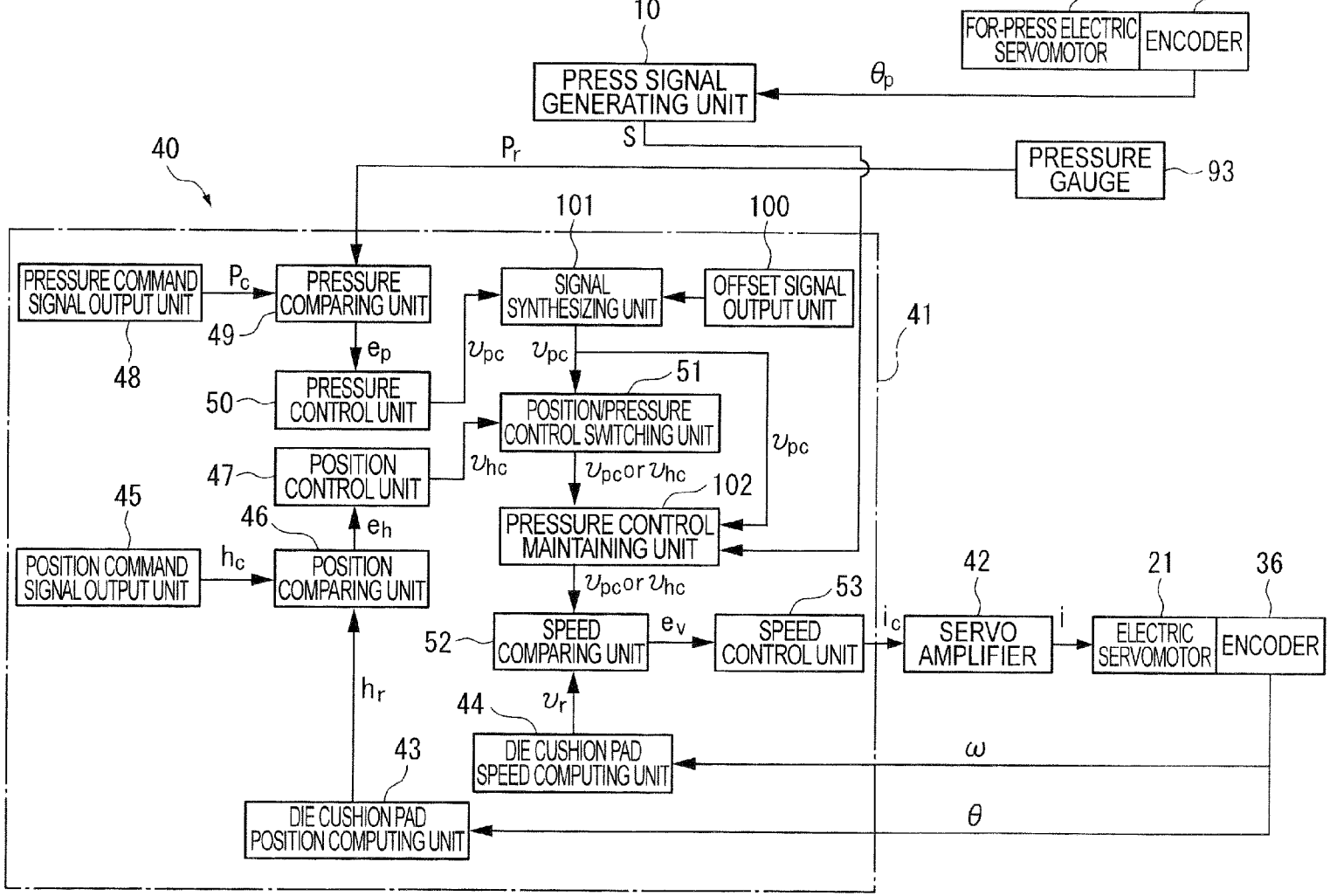
FIG. 27 A functional block diagram illustrating a die cushion controller according to the fifth modification.
Figure 28:
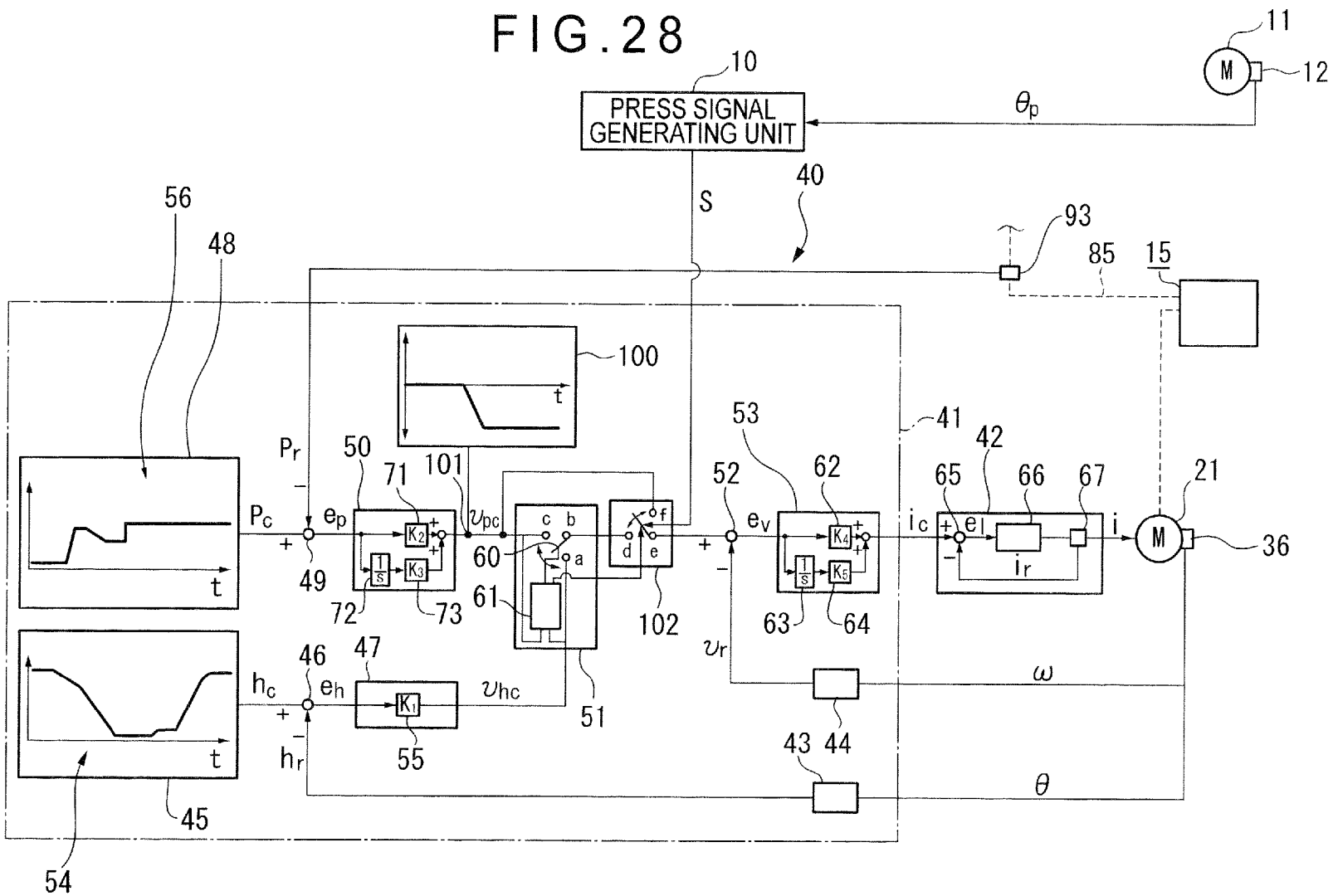
FIG. 28 A control block diagram illustrating the die cushion controller of the fifth modification.

In view of this, in this modification, as shown in a functional block diagram of FIG. 27 and a control block diagram of FIG. 28, the controller 41 is provided with a pressure control maintaining unit 102. The rest of the arrangement of this modification is the same as the fourth modification.

As shown in FIG. 28, the pressure control maintaining unit 102 functions as a switch having contacts d, e and f. In the pressure control maintaining unit 102, when, after the upper die 7 has touched the workpiece 9 (time t12), the switch 60 is switched to b-c contact connecting operation and switching is effected from position control to pressure control, e-f contact connecting operation is simultaneously performed by a switching signal from the position/pressure comparing unit 61 (FIG. 26). In this e-f contact connecting operation, the position/pressure control switching unit 51 is bypassed, and the first speed command signal υpc is constantly output to the speed comparing unit 52, thus maintaining pressure control. Thus, if, in this while, the position target of the die cushion pad 15 becomes smaller than the actual position, it is possible to prevent switching to position control. In the pressure control maintaining unit 102, when the slide 4 reaches to the bottom dead center and switching to position control is effected by the position/pressure control switching unit 51, switching to e-d contact connecting operation is effected through input of a press signal S from a press signal generating unit 10 (FIG. 26), and the second speed command signal υhc having passed through the position/pressure control switching unit 51 is output to the speed comparing unit 52. Then, based on the motor rotation angle detection signal Op output from the encoder 12 of the press-use electric servomotor 11, the press signal generating unit 10 outputs the press signal S, which undergoes on/off switching when the slide 4 reaches the bottom dead center position.

Figure 29:
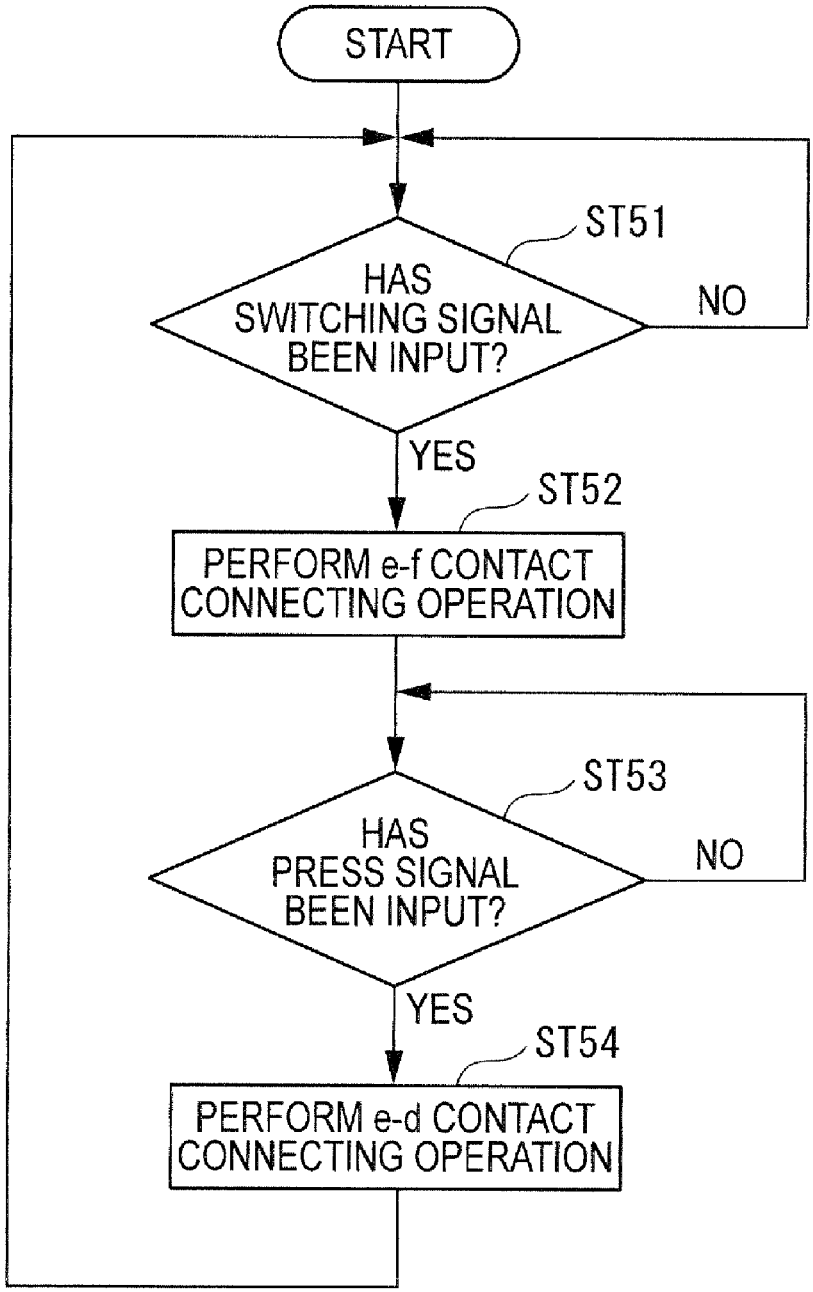
FIG. 29 A flowchart for illustrating an operation of a pressure control retaining unit.

The operation of the pressure control maintaining unit 102 will be described with reference to a flowchart of FIG. 29.

ST51: In the state before the touching, in which position control is effected, the pressure control maintaining unit 102 monitors the switching signal from the position/pressure control comparing unit 61.

ST52: When, immediately after the touching, switching is effected to b-c contact connecting operation by the switch 60, and switching is effected from position control to pressure control, switching to e-f contact connecting operation is simultaneously effected in the pressure control maintaining unit 102 by a switching signal from the position/pressure control comparing unit 61, thus maintaining pressure control.

ST53: The pressure control maintaining unit 102 that maintains pressure control monitors the input of the press signal S from the press signal generating unit 10.

ST54: When the slide 4 reaches the bottom dead center position, and the press signal S is input to the pressure control maintaining unit 102, switching to e-f contact connecting operation is effected at the pressure control maintaining unit 102, and the pressure control maintaining state is canceled. At the same time, switching to b-a contact connecting operation is effected at the switch 60, so that switching is effected from pressure control to position control to conduct position control subsequent to the bottom dead center.

The best construction, method, etc. for carrying out the present invention as disclosed above should not be construed restrictively. Specifically, while illustrated and described mainly in relation to particular embodiments, the present invention allows those skilled in the art to make various modifications on the above-mentioned embodiments in terms of configuration, amount and other details without departing from the scope of technical idea and objective of the present invention.

Thus, the above disclosure with limitations in terms of configuration, amount or the like is only given to facilitate the understanding of the present invention, and should not be construed restrictively. Therefore, any description given with reference to members named with partial or no limitations in terms of configuration, amount or the like is to be covered by the scope of the present invention.

INDUSTRIAL APPLICABILITY

The present invention is applicable to a die cushion controller that controls a die cushion used in a press machine for drawing or the like, in particular, to be suitably used as a die cushion controller for a die cushion driven by an electric servomotor.

The invention claimed is:

1. A die cushion controller, comprising:

a pressure command signal output unit that outputs a pressure command signal corresponding to a pressure target value based on a predetermined pressure pattern;

a pressure detector that detects a pressure applied to a die cushion pad;

a pressure comparing unit that outputs a pressure deviation signal corresponding to a deviation between the pressure target value based on the pressure pattern and a pressure detection value based on a pressure detection signal from the pressure detector;

a pressure control unit that outputs a first speed command signal based on the pressure deviation signal;

a position command signal output unit that outputs a position command signal corresponding to a position target value based on a predetermined positional pattern;

a position detector that detects a position of the die cushion pad;

a position comparing unit that outputs a position deviation signal corresponding to a deviation between the position target value based on the positional pattern and a position detection value based on a position detection signal from the position detector;

a position control unit that outputs a second speed command signal based on the position deviation signal;

a position/pressure control switching unit that selects the first speed command signal or the second speed command signal;

a speed control unit that outputs a motor current command signal based on the first speed command signal or the second speed command signal from the position/pressure control switching unit; and a servo amplifier that supplies an electric servomotor which drives a die cushion with an electric current corresponding to the motor current command signal, wherein the position/pressure control switching unit compares the first speed command signal and the second speed command signal and selects a smaller one of the first speed command signal and the second speed command signal.

* * * * *